US010306948B2

(12) United States Patent
Stien

(10) Patent No.: US 10,306,948 B2
(45) Date of Patent: Jun. 4, 2019

(54) FOOTWEAR WITH TAPERED HEEL AND METHODS OF MANUFACTURE AND MEASUREMENT

(71) Applicant: Karl Stien, Eau Claire, WI (US)

(72) Inventor: Karl Stien, Eau Claire, WI (US)

( * ) Notice: Subject to any disclaimer, the term of this patent is extended or adjusted under 35 U.S.C. 154(b) by 33 days.

(21) Appl. No.: 15/494,724

(22) Filed: Apr. 24, 2017

(65) Prior Publication Data

US 2017/0224049 A1 Aug. 10, 2017

Related U.S. Application Data

(63) Continuation-in-part of application No. 15/078,628, filed on Mar. 23, 2016, now Pat. No. 9,629,413.

(60) Provisional application No. 62/136,756, filed on Mar. 23, 2015.

(51) Int. Cl.

| | |
|---|---|
| ***A43B 13/14*** | (2006.01) |
| ***A43B 13/12*** | (2006.01) |
| ***A43B 7/22*** | (2006.01) |
| ***A43B 7/24*** | (2006.01) |
| ***A43B 13/18*** | (2006.01) |

(52) U.S. Cl.

CPC ..... *A43B 13/125* (2013.01); *A43B 7/223* (2013.01); *A43B 7/24* (2013.01); *A43B 13/12* (2013.01); *A43B 13/143* (2013.01); *A43B 13/145* (2013.01); *A43B 13/148* (2013.01); *A43B 13/185* (2013.01)

(58) Field of Classification Search

CPC ..... A43B 13/00; A43B 13/12; A43B 13/14; A43B 13/141; A43B 13/143; A43B 13/145; A43B 13/146; A43B 13/16; A43B 7/14; A43D 2200/00

USPC ..... 36/25 R, 30 R, 103, 107, 27, 102, 142, 36/143, 144; 12/142 R, 146 B, 146 M

See application file for complete search history.

(56) References Cited

U.S. PATENT DOCUMENTS

| | | | | | |
|---|---|---|---|---|---|
| 4,425,721 | A * | 1/1984 | Spronken | A43B 3/128 | 36/11.5 |
| 4,962,760 | A * | 10/1990 | Jones | A61F 5/0127 | 126/88 |
| 5,727,335 | A * | 3/1998 | Kousaka | A43B 7/14 | 36/140 |
| 5,865,778 | A * | 2/1999 | Johnson | A43B 7/20 | 36/88 |
| 6,745,501 | B2 * | 6/2004 | Brown | A43B 7/141 | 36/174 |
| 7,069,665 | B1 * | 7/2006 | Adriano | A43B 7/142 | 33/3 R |

(Continued)

*Primary Examiner* — Marie D Bays
(74) *Attorney, Agent, or Firm* — Anthony J. Bourget

(57) ABSTRACT

A method of manufacturing footwear and an article of footwear having a tapered heel in part defining an impact point associated with a padded impact zone which first strikes a surface upon a foot plant and a plate embedded within a sole of the article such that the plate supports the heel of the sole from flexing or collapsing. The impact point is part of an impact area (F) positioned adjacent an ankle pivot axis of the wearer's ankle, and in one aspect is positioned at or slightly posterior the ankle pivot axis. In one aspect the method includes configuring a sole of the footwear based on an ankle pivot characteristic or balance pivot characteristic of a wearer in a custom manufacture or based on the same of a typical or an ordinary wearer in a non-custom manufacture.

25 Claims, 13 Drawing Sheets

(56) References Cited

U.S. PATENT DOCUMENTS

| | | | | |
|---|---|---|---|---|
| 7,150,114 | B2 * | 12/2006 | Park | A43B 7/146 36/103 |
| 8,221,341 | B1 * | 7/2012 | Al-Oboudi | A61F 5/0127 36/103 |
| 8,657,767 | B2 * | 2/2014 | Chan | A61F 5/0127 128/846 |
| 8,984,770 | B1 * | 3/2015 | Piontkowski | A43B 1/0054 36/102 |
| 2007/0130798 | A1 * | 6/2007 | Cockburn | A43B 3/108 36/11.5 |
| 2011/0192051 | A1 * | 8/2011 | Wadman | A43B 3/0042 36/88 |
| 2013/0205620 | A1 * | 8/2013 | Hsu | A43B 7/14 36/91 |
| 2014/0059887 | A1 * | 3/2014 | Lawlor | A43B 3/26 36/83 |
| 2014/0115930 | A1 * | 5/2014 | Svensson | A43B 5/0411 36/117.3 |
| 2015/0157087 | A1 * | 6/2015 | Blumenthal | A43B 21/42 36/100 |

* cited by examiner

FOOTWEAR WITH TAPERED HEEL AND METHODS OF MANUFACTURE AND MEASUREMENT

CROSS-REFERENCE TO RELATED APPLICATIONS

This application is a continuation-in-part and claims the benefit and priority of U.S. patent application Ser. No. 15/078,628 filed on Mar. 23, 2016, now U.S. Pat. No. 9,629,413 issued Apr. 25, 2017, for FOOTWEAR WITH TAPERED HEEL, SUPPORT PLATE, AND IMPACT POINT MEASUREMENT METHODS THEREFORE, and of Provisional Patent Application Ser. No. 62/136,756, filed Mar. 23, 2015, for FOOTWEAR WITH TAPERED HEEL AND ARCH SPRINGS, incorporated herein by reference as if fully reproduced herein.

BACKGROUND OF THE INVENTION

1. Field of the Invention

The present inventive concept relates generally to footwear having a special sole to provide for improved biomechanical operation, including improved foot-plant and together with a support mechanism for enhanced comfort and use, and related methods of manufacture and methods of measurement.

2. Background Information

There are numerous types and styles of footwear and soles for use with footwear. Some examples of footwear having various sole design and various springing mechanisms include those disclosed in patents such as U.S. Pat. No. 8,209,883, 7,231,728, 8,474,154, 4,128,950, U.S. Patent Application No. 2013/0205619, among others.

While the foregoing products and methods may be beneficial, there is always room for improvement.

SUMMARY OF THE INVENTION

Applicant has recognized the footwear industry today tends to lack knowledge of how the foot biomechanically conforms to surfaces or performs when hiking, running, or walking, or recognizes that the industry simply provides products inadequate in this regard. The midfoot or forefoot are designed or have evolved in such a way that when a foot comes in contact with a surface, flexion of the ankle and plantar mechanism occur and the impact is placed upon the muscle fibers in such a way that provides for efficient relaxation-contraction and allows a powerful stride. Applicant has recognized that when the impact from contacting a surface is placed within the heel area, the plantar and ankle mechanisms are not utilized, or are not optimally utilized. The biomechanical structure of a heel impact forces the knee and hip to absorb the force, or absorb a greater-than-natural force, causing injury. Shoes today are cushioned in the heel and provide only minimal mitigation of the forces absorbed by the body during a heel strike. Without heel cushioning, and over longer distances, the heel impacts will result in painful sensory feedback, and to avoid the discomfort, a person will naturally shift the impact from the heel to the mid to fore-foot. Such heel cushioning over time can cause dramatic injury, particularly with heavier individuals and those who travel far distances. The current footwear with a cushioned heel absorbs enough of the heel impact to bypass the heel's sensory feedback. Over time and distance, the lack of sensory feedback with a cushioned heel impact often result in chronic injury to the plantar mechanism, knees, hips and/or spine.

Applicant has developed a sole believed to minimize strain upon the knees, hips, and spine, and decrease injury and allow natural foot/ankle movement. Biomechanically, an individual's foot is built to walk without shoes. Therefore, the arch and plantar mechanism are designed to act as a spring when the forefoot is loaded on impact. The thicker tissue on the foot demonstrates where a foot should truly contact a surface. The thick tissue padding extends from the posterior part of a foot, down through the lateral side of the foot, across the lateral metatarsals and ends in the forefront of the foot. There is also thicker tissue at the end of each toe. Applicant recognizes the arch region has no such tissue thickening. The heel pad is meant to support static standing for balance, but not meant to absorb the impact associated with a striding motion.

"Barefoot" shoes permit sensory feedback given by the heel, thus decreasing the individual's likelihood of making a heel strike. However the barefoot shoe lacks comfort when contacting the surface because it lacks significant thickness in cushioning at the impact zones of the lateral midfoot-foot and forefoot. Further unrecognized in existing footwear's technology today is the failure to address and promote the biomechanically correct method of running and walking. One aspect of Applicant's invention allows for a rigid plate-like heel which gradually tapers into an adequately cushioned pad at the lateral midfoot area. The plate-like material extends to or through the forefoot/metatarsals while the pad extends to or through to the toes. Applicant refers to the cushioned area at the midfoot area as the "impact zone." In this midfoot area or impact zone is a junction where the tapered heel transitions to a flattened lateral portion at the midfoot. In one aspect a junction line is defined. Impact point or points lie along the junction line, also referred to as the impact line. The junction or junction line is positioned anterior the pivot point of the ankle of a wearer such that the ankle will dorsiflex (i.e., toes point upward), absorb the energy of the foot strike by loading the soleus/gastrocnemius, and then release that energy at the end of the stride. There is limited or no padding between the person's heel and the rigid plate. There is padding between the wearer's midfoot and the rigid plate, with such padding gradually increasing from the posterior aspect of the midfoot to the anterior aspect of the midfoot. The padding may increase because the plate slopes downward from an upper area of the sole to a lower area of the sole. In one example the rigid plate spans substantially or the entirety of the width of the heel and midfoot. In another example the rigid plate spans primarily along the medial aspect of the midfoot while avoiding the lateral aspect. In one aspect a pad or cushioned area lies laterally along the midfoot corresponding to where a foot's natural padding is positioned. In one example the rigid plate extends from the heel through the medial and central midfoot arch. In some aspects the plate has some inherent flex which may provide a springing action. A plate may be made from a variety of materials, including but not limited to carbon fiber.

The plate is configured to support the heel (which heel is suspended posteriorly due to the tapered orientation of the heel, i.e., absence of material positioned below the heel and above the surface) and prevent impact occurring between the arch of the foot and the surface. While the weight or force of the wearer acts upon the plate at the medial and central midfoot arch during a step or stride, the heel is supported/suspended by the rigid plate which extends posteriorly. The rigid plate operates as a spring or dampening force or anti-sag mechanism, storing energy during the early phase of the stride and then releasing it at or toward the end of the stride.

In further method aspects of the invention the pivot point or junction line of the sole is determined based on the physiology of a particular wearer. If the pivot point is positioned posterior to, at or generally near the Pivot Axis of the tibia, a foot plant will most likely tend to not result in a desired dorsiflex of the ankle; and where the impact point is positioned remotely anterior with respect to the Pivot Axis, the wearer will experience a rocking action such that the heel of the shoe or boot will contact the surface when the wearer is standing still under natural balance. As the anteriorly remote pivot point (or junction/impact line) is positioned closer to the Pivot Axis, the tendency of the wearer to rock backward will be reduced. Successive adjustments can be made regarding the positioning of the impact point with respect to the Pivot Axis to determine a preferred position (to the custom fit or desire of the wearer) where the wearer may stand erect comfortably without rocking back and forth which would otherwise occur due to the heel taper. A number of pivot point measuring techniques and associated devices are contemplated within the scope of the present invention.

The above abbreviated summary of the present invention is not intended to describe each illustrated embodiment, aspect, or every implementation or object of the present invention. The figures and detailed description that follow more particularly exemplify these and other embodiments and further aspects of the invention. Other features and advantages of the invention will be apparent from the following description, the accompanying drawings and the appended claims.

BRIEF DESCRIPTION OF THE DRAWINGS

The invention may be more completely understood in consideration of the following description of various embodiments of the invention in connection with the accompanying drawings, in which.

Figure 1:
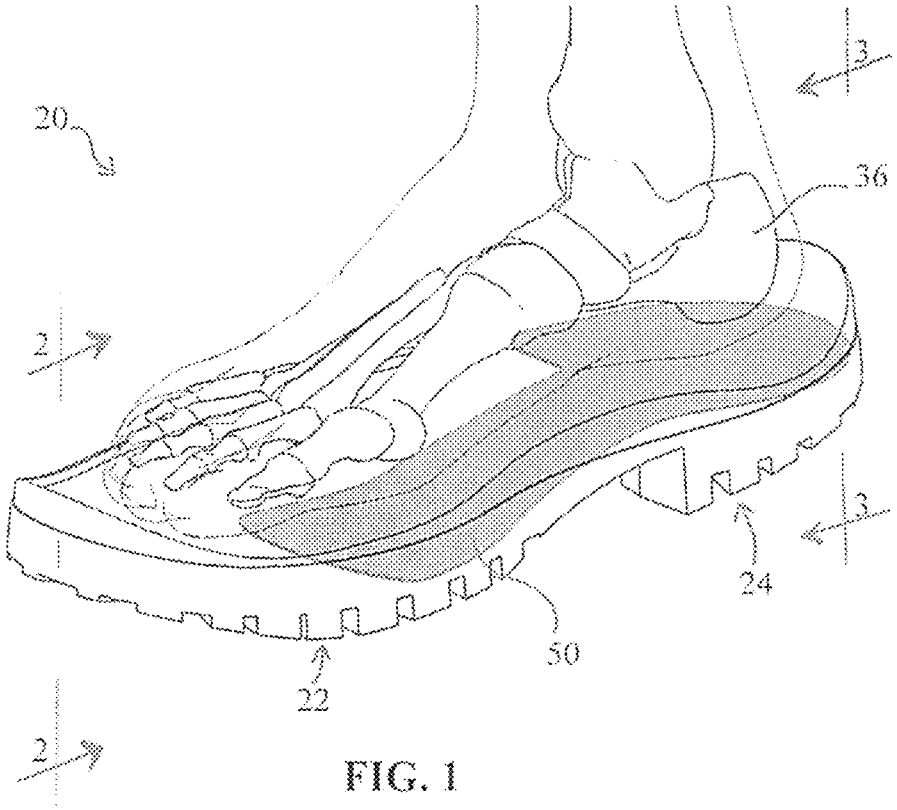
FIG. 1 is a perspective view of an article of footwear in accordance with an aspect of the present invention and presenting a partial skeletal and flesh structure of a right foot for illustration, an upper removed and a component revealed for clarity.

While the invention is amenable to various modifications and alternative forms, specifics thereof have been shown by way of example in the drawings and will be described in detail. It should be understood, however, that the intention is not necessarily to limit the invention to the particular embodiments described. The intention is to cover preferred embodiments, modifications, equivalents, and alternatives falling within the spirit and scope of the invention and as defined by the appended claims.

DETAILED DESCRIPTION OF THE INVENTION

The subject inventive system may take on numerous physical and method embodiments within the spirit of the invention and only preferred embodiments have been described in detail below, which are not meant to limit the scope and/or spirit of the invention.

Human foot bones and structures have inspired the present invention. Aspects of the invention include a tapered/angled heel sole of an article of footwear and a combined heel support mechanism as further shown below.

Applicant appreciates that current footwear fails to address the need for true bio-mechanical movement throughout the foot. The need for a bio-mechanical design to allow proper impact of a foot to a surface is imperative to prevent injuries and fatigue, and to provide comfort for the consumer.

Applicant has come to appreciate that bio-mechanically the midfoot or forefoot are the appropriate sites for impact with running, hiking, or walking, which allows the arch of the foot and the plantar mechanism (muscle/tendon/fascia) to flex on impact in addition to permitting the ankle and the gastrocnemius/soleus muscles to bear a substantial portion of the impact. The flexing of ankle and plantar mechanism during appropriate impact expands the muscle fibers such that they are optimally primed for contraction and a powerful stride.

When the primary impact from a footfall is the heel, the plantar and ankle mechanism are not utilized, hence the knee (and to a lesser extent the hip and spine) must bear the brunt of the force. Bio-mechanically, the motion of the knee and hip during walking and running is not designed to adequately absorb the force from a heel impact. This results in abnormal stress on the entire skeleton from a heel impact. A heel impact also causes stress to the calcaneus and the origin of the plantar tendon. The plantar tendon is designed to bear forces in the parallel plane, not the transverse plane as with a heel strike.

Shoes, which are cushioned in the heel, slightly mitigate the forces with a heel strike, but not substantially. With fewer impacts (short distances) or lighter individuals, a heel strike with padded shoes often will not result in any immediate symptoms. However, heavier individuals or more impacts (longer distances) will often result in pain, which indicates injury.

Heel cushioned shoes also encourage heel strikes by absorbing enough of the impact to bypass the heel's natural sensory feedback. Without a cushioned heel, the calcaneus and the adjacent pad of the heel will start generating a pain signal with repeated impacts. This should modify the stride so that the heel is not taking the impact. The arch and plantar mechanism are bio-mechanically designed to act as springs when the forefoot is loaded on impact, but not to take an impact force from the plantar direction. The positioning of thicker "padded" subcutaneous tissue illustrates exactly where a person's feet are supposed to contact the ground. This thicker tissue "padding" extends from the heel, down the lateral aspect of the foot, across the metatarsal heads with small pads at the ends of the toes. The arch region has no such tissue thickening. Current footwear has an impact surface area that extends across the midfoot and often directs that force into the arch through "arch support". These types of abnormal forces often in conjunction with a heel strike placing a similar plantar force on the origin of the plantar tendon from the calcaneous highly likely contribute to plantar tendon, muscle, and fascial injuries.

"Barefoot" shoes with little or no padding throughout the entire foot have helped alleviate the problem of heel striking by making sure the sensory feedback loop from the heel is not mitigated. However, such "barefoot" shoes do not provide adequate padding at the midfoot or forefoot which is appropriately bearing the substantial impact. This makes the shoes/boots or other similar footwear seem less comfortable, which inherently decreases the likelihood of people using or buying them. Additionally, the lack of padding does increase the transmission of heat from the ground (hot feet) and the risk of developing a stress injury to the midfoot or forefoot, particularly in individuals who are not accustomed or habituated to the bio-mechanically correct method of walking and running.

Current footwear addresses the need for additional cushioning throughout the foot to provide comfort on an impact, and in other inventions, a spring like mechanism to absorb shock. While current designs allow the foot to absorb minor heel impacts without causing stress to the body's calcaneus and plantar tendon, they do not address the fact that a foot is not designed to impact a surface with an individual's heel. The current invention, however, is bio-mechanically correct as it persuades the foot to contact the surface through lateral midfoot and fore-foot areas in order to prevent injury, particularly to the plantar mechanism, knees, hips, and spine.

Figure 2:
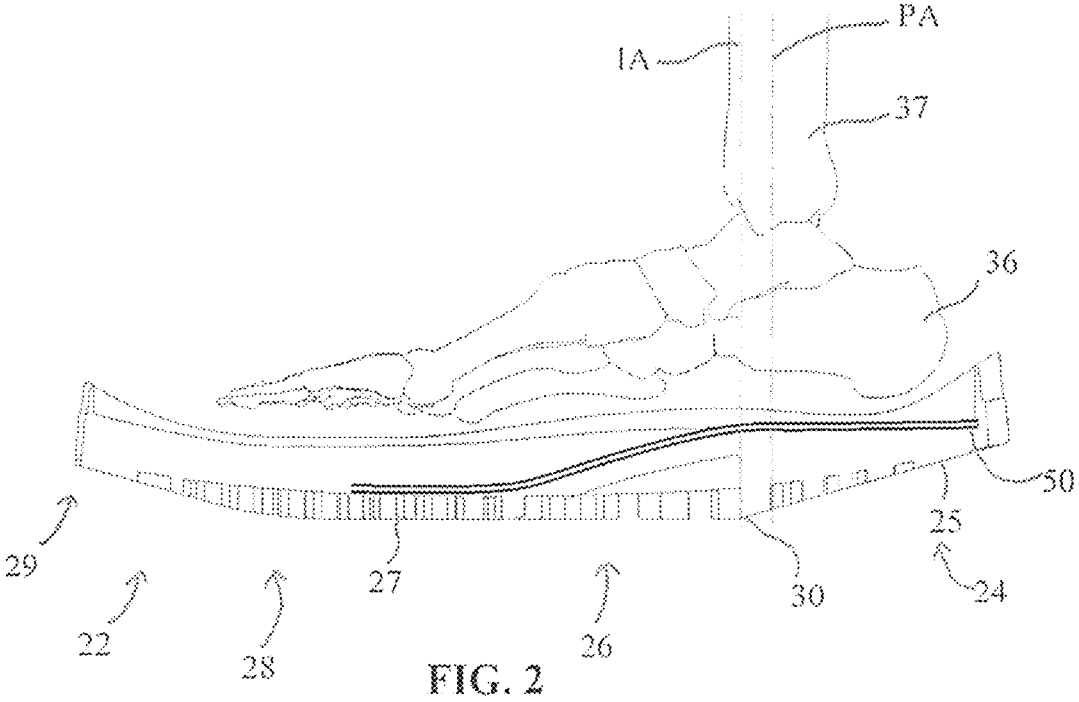
FIG. 2 is a section view taken along line 2-2 of FIG. 1.

Referring to FIGS. 1-22, various aspects of the invention are shown. FIG. 1 depicts one example of a footwear article 20 of the invention which may include a shoe or boot or other article of footwear. FIG. 1 is a perspective view of a portion of footwear article 20 with an upper removed for clarity and illustrating flesh and skeletal structure of an ankle of a wearer. For clarity, FIG. 1 also reveals a plate aspect of the invention discussed below. Footwear article 20 may include upper 21 (See FIG. 13) such as an upper of a shoe or boot or other type of footwear upper which may include a leather, rubber, fabric, plastic, synthetic or other component and is configured to receive a foot of a wearer. Upper 21 is connected to sole 22. Footwear 20 includes a sole 22 having a tapered heel 24. Heel 24 leads to midfoot 26 which leads to forefoot 28. Toe 29 extends from forefoot 28. Sole 22 includes a junction line 30 also known as an impact line 30. In one aspect junction line 30 delineates the transition from tapered heel 24 to midfoot 26. As shown in FIG. 2, heel 24 is tapered or angled with respect to midfoot 26. In one aspect a heel line 25 is angled with respect to midfoot line 27. The forefoot 28 is shown angled with respect to the midfoot 26 up to the toe 29; however, this is not required. For example, a substantially flat midfoot surface may extend fully to the toe 29. Thinning of the sole in the region of the toe 29 may allow that region to more readily flex without detrimental toe impact.

Figure 3:
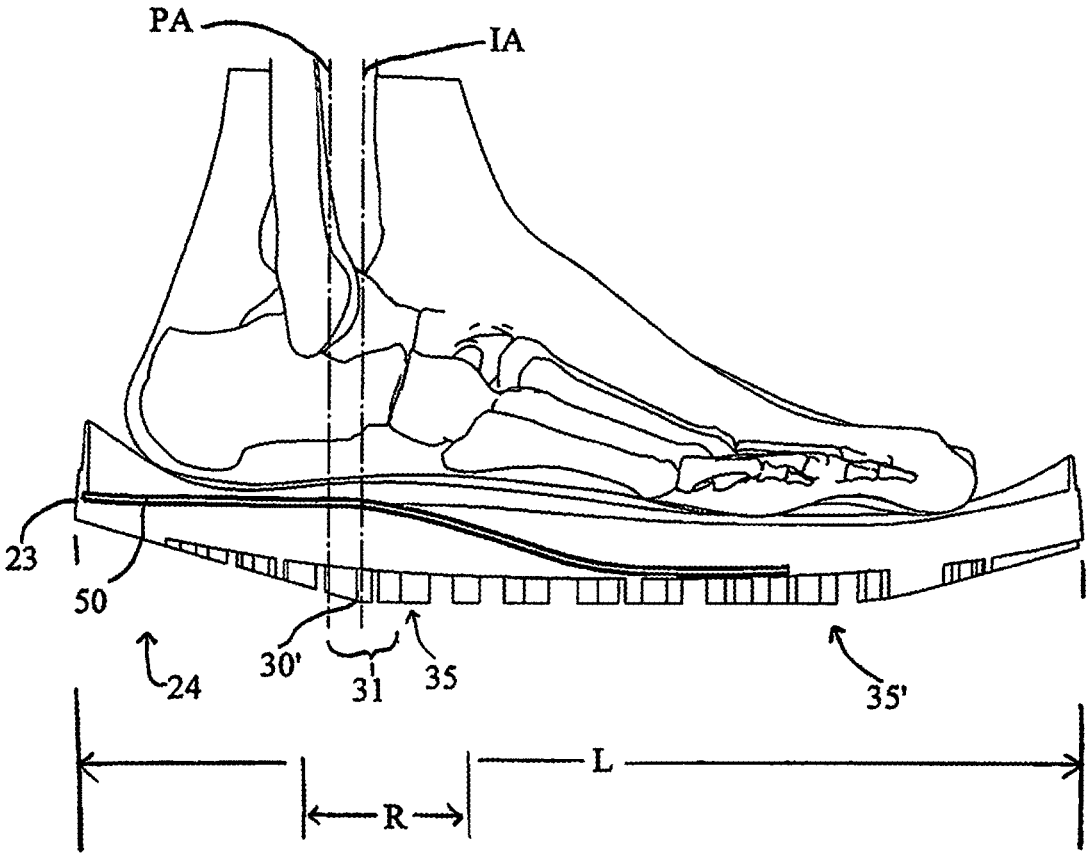
FIG. 3 is a section view taken along line 3-3 of FIG. 1.

Impact point 30' or points 30' lie along and/or form impact line 30. Impact line 30, and associated impact point or points 30', is located anterior to the ankle Pivot Axis (PA) as shown in FIG. 2 and FIG. 3. In some aspects impact line 30 may span generally the width of sole 22. The impact line 30 demarcates the end of tapered heel 24. This transition, while characterized as a "line" 30, does not have to be precisely linear so long as the structure functions, as hereinafter described. That is, the midfoot 26 and heel 24 do not have to meet at a straight line. Different shapes and materials might be used to allow the controlled desired movement of the heel 24 relative to the midfoot 26, as with respect to a reference line.

Figure 5:
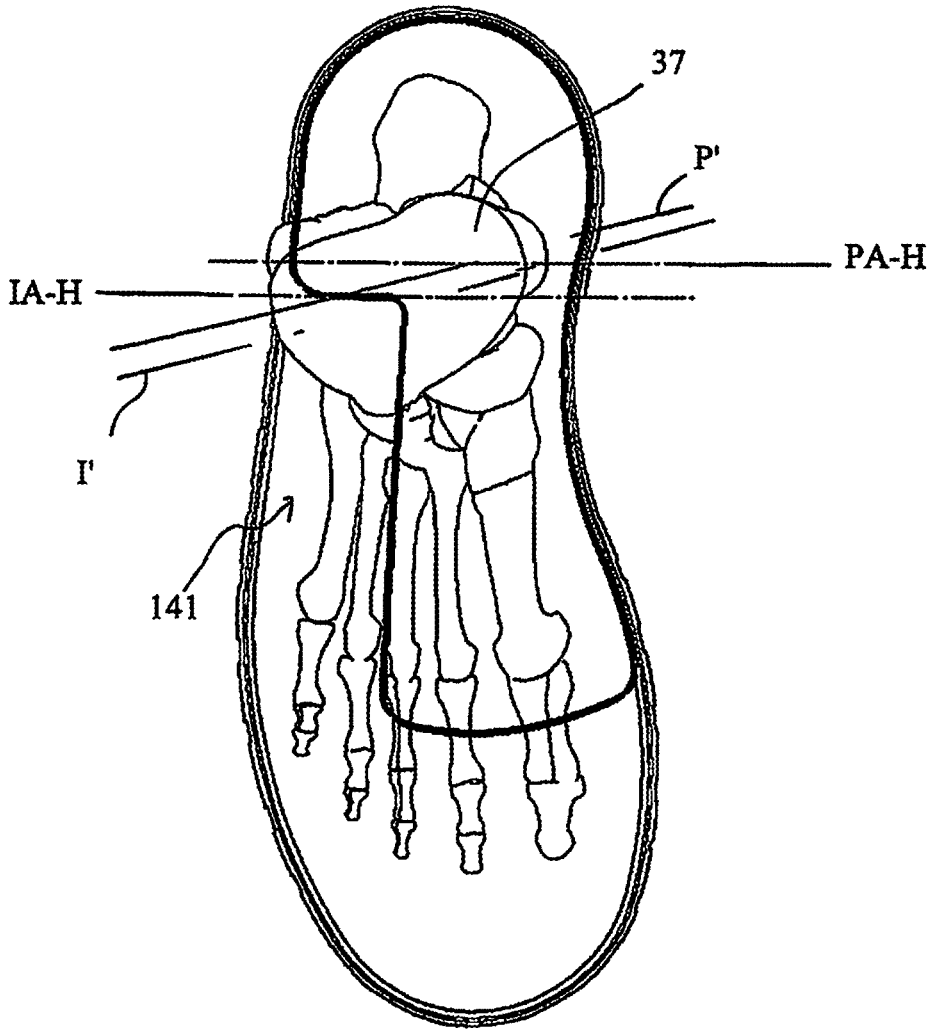
FIG. 5 is a top view of the article of FIG. 1.

The Pivot Axis PA is a central vertical axis of the tibial-talar joint, or recognizing the human body includes loose or floating joint aspects, the Pivot Axis PA is a vertical axis demarcating a general line of rotation of the ankle joint in a dorsiflex motion of the foot. The Pivot Axis PA is shown or measured perpendicularly to the surface upon which sole 22 rests. While recognizing that it may or may not always coincide with the actual or perfect positioning of the true axis of the joint, for the purposes of ascertaining an objective reference point without directly testing a particular wearer, the central axis of the tibia may be used here as the axis coinciding with the pivot axis of the ankle. The true Pivot Axis PA and/or PA-H of a person may be measured with reasonable certainty as shown below. As shown in FIG. 5, horizontal Pivot Axis PA-H aligns with a central area of tibia 37 (and intersects with Pivot Axis PA) and represents an axis about which a person's foot dorsiflexes or rotates upward/downward. The horizontal Pivot Axis PA-H shown in FIG. 5 represents an axis of perpendicular alignment with respect to sole 22.

Impact line 30 is situated on Impact Axis IA. Impact Axis IA is parallel to and offset anteriorly from Pivot Axis PA. In this aspect impact line 30 is oriented perpendicular with respect to sole 22. As shown in FIG. 5, the impact axis may be skewed or tiled at an angle as shown by axis P', with a corresponding alteration of impact axis as shown by axis I'. It may be appreciated that where an impact line 30 is configured as a straight line, the ankle joint will tend to flex or rotate along or about the impact line 30. Thus, the plant angle of the ankle/foot may be influenced by tilting the slope of the impact line 30. For instance, an impact line 30 which is oriented along the impact axis I' will tend to cause a foot plant where the toes point inward during the step or stride; whereas, if the impact line 30 is sloped an opposite direction, the foot will tend to plant such that the toes are directed outward from the body. Altering the slope of the impact line 30 therefore allows for rehabilitation of or accommodation to fit a wearer's foot plant or stride. Such variations may relieve (or accentuate) stresses at the knees or other skeletal structures of a wearer.

As shown in FIG. 3, Impact Axis IA is situated anterior Pivot Axis PA. It may be appreciated that positioning impact axis IA anterior to Pivot Axis causes the ankle to dorsiflex, i.e., the front of the foot will tend to lift or flex upward.

Figure 4:
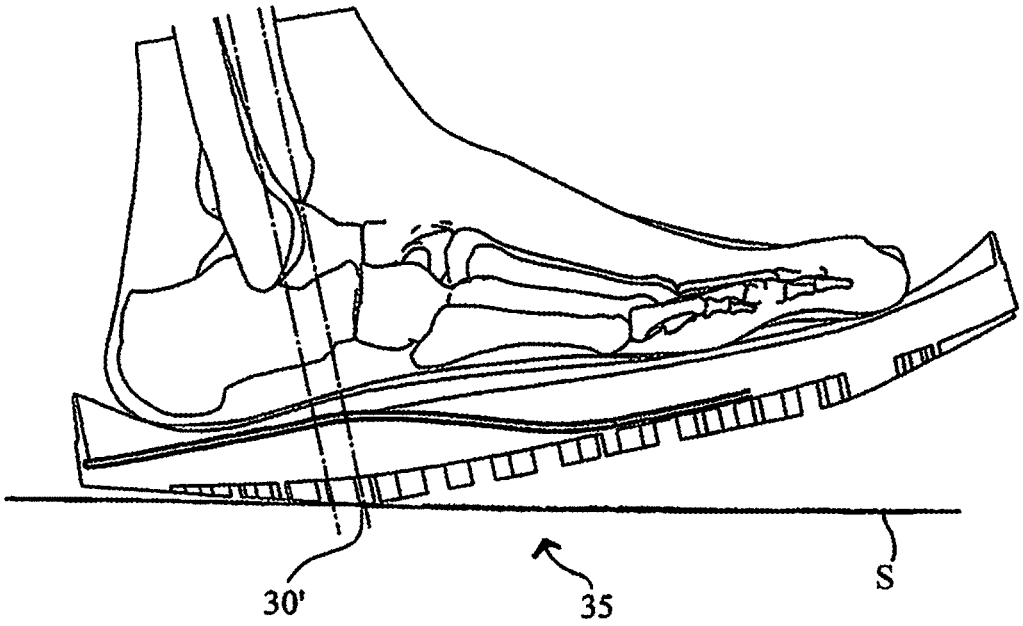
FIG. 4 is a further view of the article of FIG. 3.

FIG. 4 depicts sole 22 in a walking or running motion just as sole 22 is striking the surface S in one representative stride. As shown in this example the heel 24 is not in contact with surface S and the impact forces are received at least in part at impact point 30' and/or along impact line 30. Because impact point 30' is situated anterior pivot axis PA, a natural mechanical action causes or tends to cause the ankle to flex, thus engaging the gastrocnemius or other muscles of the leg as desired. If the impact axis were positioned even further anteriorly from pivot axis PA, the mechanical advantage of the flexing forces would be even greater for a more dramatic flex of the ankle; whereas the opposite would be the case if the impact axis IA were positioned closer to the pivot axis PA. At some point where the impact axis IA approaches the pivot axis PA (or even where the impact axis IA is posterior the pivot axis PA, such as perhaps where there is a severe heel taper), the mechanical flex of the ankle will be minimal or nonexistent.

As shown in FIG. 3, due to the flexibilities of the human ankle and given different preferences, the impact point 30' and impact line 30 may be situated at impact line region 31 and still produce a desired flex as described. At some distance beyond region 31, the flex action will still be present (even accentuated), yet the sole will rock or tip backwards or the user will feel a tendency to tip backwards when standing with the midfoot for positioned on a flat surface S. It may also be appreciated that wearers have varying skeletal foot structures, even those pertaining to feet that may fit in the same size shoe or boot. For instance, some wearers may have a longer (or shorter) calcaneus 36, or longer (or shorter) toes, or other variations of skeletal and flesh features. The pivot axis PA of one person wearing foot article 20 may be different as compared to the pivot axis PA of another person wearing the same article 20. Accordingly, as the pivot axis PA varies, so does or so can the impact axis IA. Depending on skeletal structure, the impact point 30' may be configured within impact line range R. Impact line range R is between 18-32 percent of the length L of sole 22. For instance, impact point 30' may be situated anteriorly from posterior end 23, 18% of the length L of sole 22 (with a corresponding alteration to the tapered heel 24). In another example, impact point 30' may be situated 32% of length L from end 23. A more typical skeletal structure includes an example where the impact line range R is between 20 and 30 percent, and even more typically, impact point 30' is positioned from end 23 about 25% of length L. The length of midfoot 26 as shown in FIG. 3 is about 50% of the length L, where the fore foot is shown with a slight toe rise. Depending on manufacture and performance desire, the length of midfoot 26 ranges from at least 25% of the length L or greater. With midfoot 26 lengths of less than 40 percent of length L, the thickness of sole 22 will become awkward or unworkable for manufacture and/or use. For instance, if the length of midfoot 26 were 30% (with the tapered heel 24 and slightly rising forefoot/toes 28 comprising the balance of the length L), the sole 22 would be thick and require different padding considerations, different slopes of plate 50 configurations, added height to the article 20 with corresponding balance considerations and potential tipping or rocking troubles. FIG. 3 also shows the inserted foot as positioned at (or substantially at) a flat orientation (as opposed to having a dramatic slope from heel to toe or toe to heel). The wearer will feel comfortable with such flat or relatively flat configuration, especially when standing still.

"Impact zone" 35 is where footwear 20 at the lateral aspect of the sole 22 is the first portion of sole 22 to impact a surface S when a user is walking and/or hiking. Such impact zone is oriented about the lateral aspect of the midfoot 26. The junction area or impact area is positioned slightly anterior to the ankle. The mechanics of an impact in this region cause the ankle to flex and absorb some of the force. The 4th and 5th metatarsals will also flex as the impact rolls towards the forefoot 28 with a forward stride and further flexing the ankle and lengthening the Achilles/gastrocnemius (calf). This process of increasing flexion at the ankle loads the calf for a more powerful extension and push off at the end of the stride (providing an extra "kick").

The "impact zone" 35' in the case of when a person is running is at the forefoot 28. This allows the calf muscle to absorb more of the initial force (which is greater during running) and permit a high cadence. Additional power will be generated by the calf resulting in greater speed and/or more endurance as the work load is distributed to more muscles. A forefoot strike will also allow the foot arch/plantar mechanism to be fully utilized as it stretches/flattens on initial impact and then contracts/arches at the end of the stride.

Figure 6:
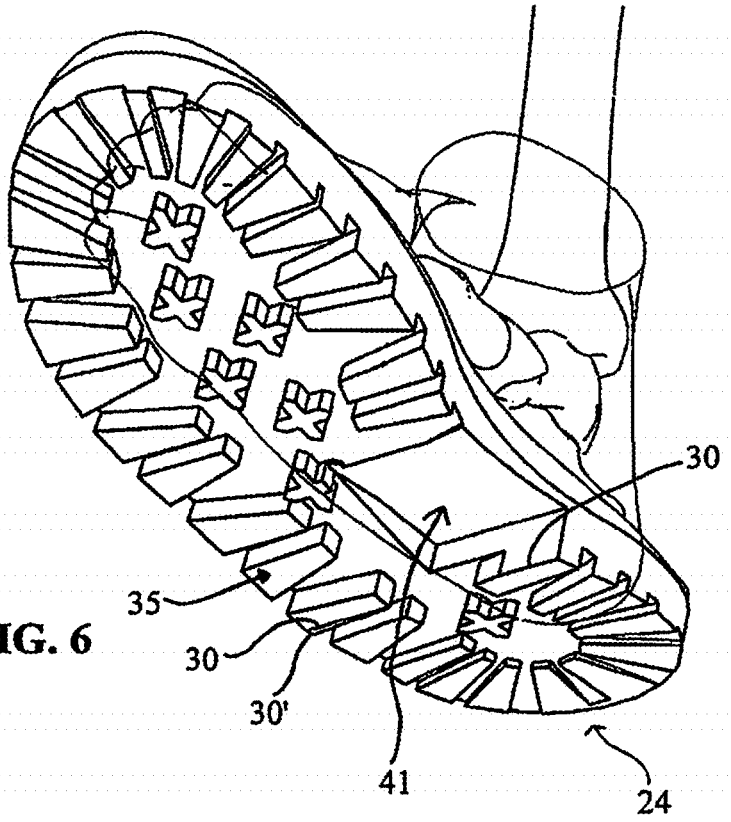
FIG. 6 is a bottom perspective view of the article of FIG. 1.
Figure 7:
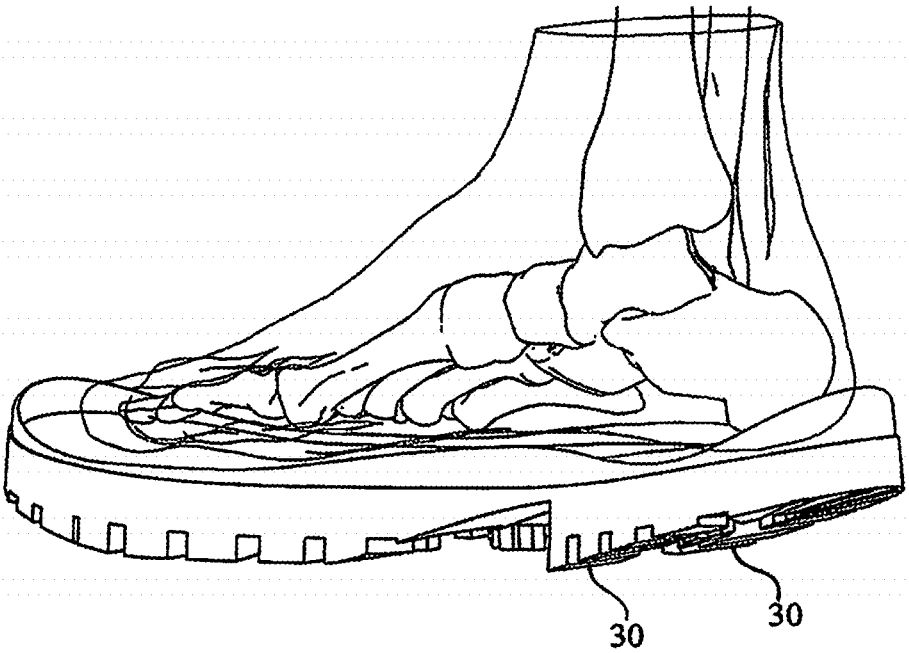
FIG. 7 is a perspective view of the article of FIG. 1.
Figure 8:
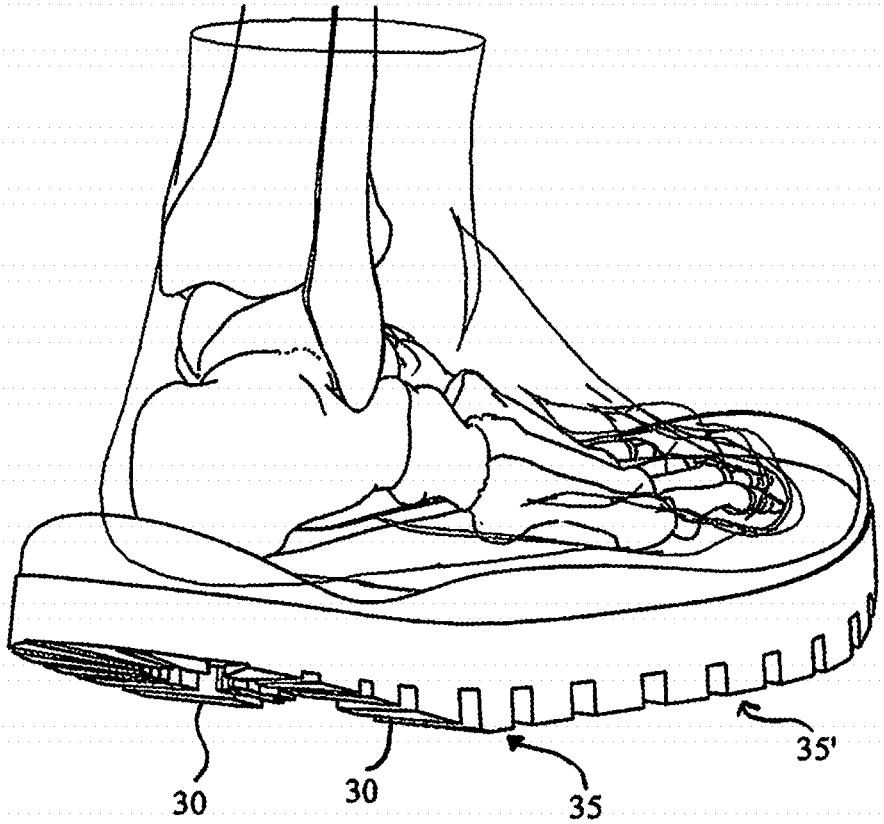
FIG. 8 is a perspective view of the article of FIG. 1.
Figure 9:
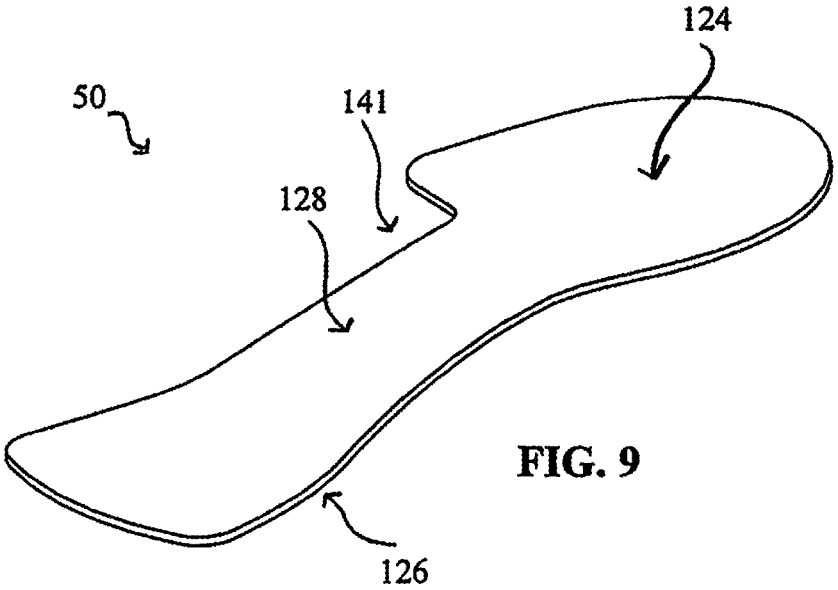
FIG. 9 is a perspective view of a component in accordance with a further aspect of the present invention.
Figure 10:
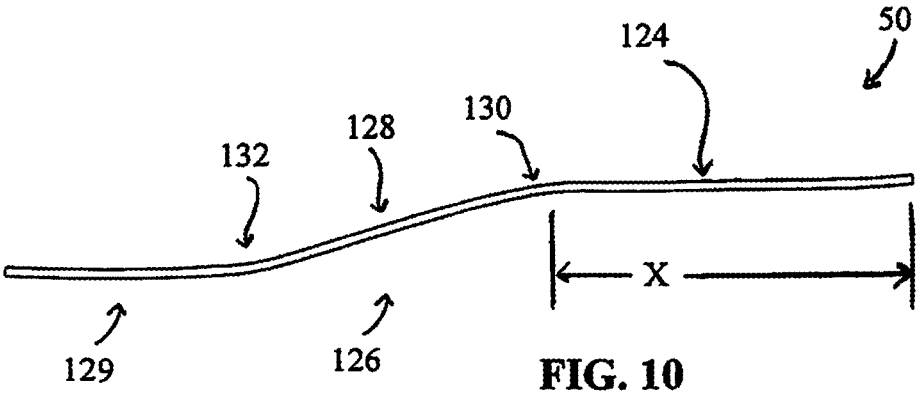
FIG. 10 is a side view of the article of FIG. 9.
Figure 11:
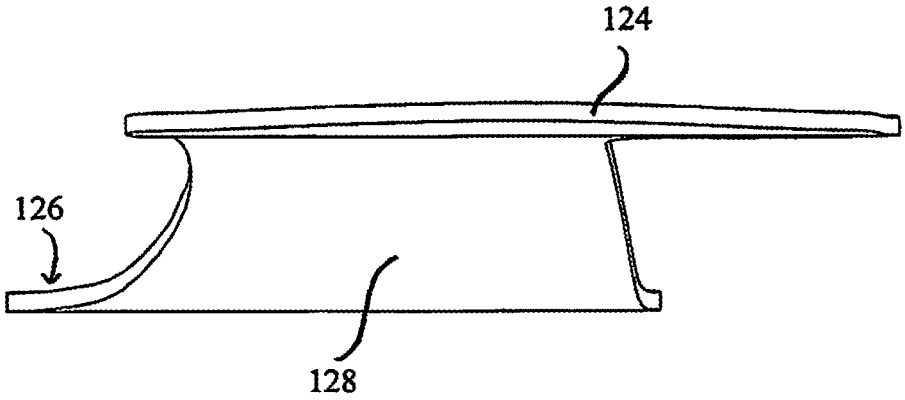
FIG. 11 is a rear view of the article of FIG. 9.

As shown in FIGS. 6-8, sole 22 defines a void 41. Particularly, void 41 is defined at least in part by an underside of sole 22 at a medial area of the sole and by heel 24 and by a lateral aspect of the sole 22. Because void 41 contains no material, such area is protected from direct force impact during a stride, which emphasizes the desire and function of a lateral side impact. In alternatives, void 41 may be filed with material or materials may extend into void 41, however the emphasis of initial impact will still be at the lateral side and in assuring a properly positioned impact point 30' or impact line 30. FIG. 7 and FIG. 8 show different view of sole 22 and illustrate the positioning of impact line 30 or impact lines 30.

In one aspect, sole 22 provides no or minimal cushioning in the region of the heel 24 and medial midfoot 26 (arch). In other aspects the sole 22 includes no cushioning at the heel 24 and the medial midfoot 26.

Orientation of heel line 25 to span in a generally straight line from posterior 23 to impact line 30 accommodates a natural midfoot contact area. For instance, having a heel 24 which tapers from posterior 23 to impact line 30 of midfoot 26 encourages a walker or hiker to make initial contact with the surface at area 30. With traditional walking or hiking footwear, the heel of the sole includes material such that the heel area tends to strike the surface first, or before the striking of the midfoot. Having a clipped heel or having a heel 24 taper from posterior 23 to midfoot 26 promotes a desired strike at the midfoot 26. Applicant believes such midfoot strike promotes improved bio-mechanical operation of the foot and ankle. In one aspect heel line 25 of heel 24 tapers to a position anterior to the ankle of the wearer. In the example of FIG. 3 the heel line 25 tapers to the impact line 30 at the beginning of midfoot 26. In this example, midfoot 26 continues in a flat or horizontal configuration. All sole regions that contact the surface S, while nominally flat and shown as flat, could be slightly contoured. For example, they may be curved concavely or convexly. In a further aspect, sole 22 may also be slightly rounded at the location of impact line 30. It may be appreciated that sole 22 has a thickness which increases from the posterior 23 to impact line 30.

The sole 22 embodying principles of the invention consists of adequate cushioning across the entire forefoot. This cushioning increases for extra padding over the $4^{th}$ and 5th Tarsal-Metatarsal joints, and in particular, the 4th and 5th Metatarsals, in addition to the Metatarsal-phalangeal joints. In one aspect the cushioning consists of a top layer which is made of a compressible material. Underneath the top compressible layer, several firmer layers help support the impact of a surface hit to the foot. These layers can be customized to a person's weight in order to perform optimally.

The inventor appreciates the foot is made to take impact to a surface through the lateral midfoot-foot and into the forefoot. The impact zone of the sole of the present invention is designed so the foot receives such impact. Similar to a walking/hiking foot strike, when running, the foot utilizes the spring mechanism when it is stretched and flattened upon a surface contact and then contracts within the arch as the foot comes to the finish of the stride. Over time it is expected that a user will begin to develop a modified and appropriate stride and foot strike. Through even short-term use a user is expected to have or develop muscle memory that repeats the desired action of impacting the midfoot-foot and/or forefoot instead of the heel area.

While the sole 22 is shown of various configurations, it may be appreciated that the sole 22 may correspond to either or both a left or right foot orientation.

In a further aspect the invention includes sole 22 with plate 50. As shown in FIGS. 1-4, plate 50 is contained within sole 22, or at least partially contained within sole 22. In one aspect the entirety of plate 50 may be encased within sole 22. In other aspects, a portion of plate 50 may extend from or may be exposed from sole 22. Plate 50 is a rigid plate or semi rigid plate. Plate 50 may be made from carbon fiber or another material, such as a metal, a plastic, a composite, etc. As shown in FIG. 2, plate 50 extends from heel 24 and through midfoot 26 and, in a preferred form, terminates adjacent the end of the midfoot area and before toe 29. The plate 50 could extend to the toe 29. With reference to FIGS. 1-5 and 9-11, plate 50 includes a plate heel 124, a plate midfoot 126 and a plate slope 128 positioned between plate heel 124 and plate midfoot 126. Plate heel 124 is flat or generally flat. Plate midfoot 126 is flat or generally flat. Plate heel 124 transitions to plate slope 128 at inflection area 130. Plate slope 128 transitions to plate midfoot 126 at inflection area 132. The plate slope 128 may be generally flat or arched, or otherwise contoured between the inflection areas 130, 132. The radius or curvature at inflection areas 130, 132 may be adjusted as desired. A relatively sharp transition at the inflection areas 130, 132 is also contemplated at different angles. The inflection area 130 begins a distance "X" from a terminal end of plate heel 124. The length of distance X may vary to accommodate placement or configuration of plate 50 within sole 22 to coincide with the structures of sole 22 addressed above. For instance, inflection area 130 may begin at a length X coinciding with a pivot axis PA and/or impact axis IA (or at some other location) as desired. The length X of plate heel 124 may be configured to match the natural skeletal structure of a user. In some aspects plate heel 124 may include a slight cup attribute.

As shown in FIG. 2, plate heel 124 is positioned proximal to a top surface of heel 24, and in some instances may be exposed and/or covered with a material, that may define a relatively thin layer. This allows for a wearer's heel to feel the sensations of a foot plant and assist in teaching muscle memory for achieving a proper foot plant. Because heel 24 is tapered, there is minimal or no direct contact of sole 22 at heel 24 with the surface S and thus minimal or no (or reduced) direct force applied to a wearer's heel upon a foot plant or stride. Plate 50 at slope 128 is covered with material such as padding which thickens as slope 128 extends anteriorly. Such thickened padding accommodates a foot plant at a lateral aspect of the midfoot 26 and especially at the impact zone 35'. Plate midfoot 126 is positioned proximal to a bottom surface of midfoot 26 which allows for a relatively thick overlay of padding. Posteriorly thereof, the plate 50 provides a changing degree of vertical support. To enhance the lateral aspect and encourage a proper foot plant, plate 50 defines a lateral void 141, which is an area in part defining impact zone 35, 35'. Absence of plate 50 at impact zone 35, 35' minimizes hard force impact at the lateral aspect of a foot. Plate heel 124 is also oriented such that a terminal end of plate heel 124 lies closer to heel line 25 as compared to plate 50 at inflection area 130. While heel 24 may taper, plate heel is flat or generally flat. In one aspect plate 50 is positioned within sole 22 such that heel plate 124 is oriented horizontally. Plate heel 124 may also be tipped as desired for alternative performance.

As shown in FIG. 2, plate heel 124 suspends rearward from impact line 30. Because heel 24 is tapered, heel 24 might otherwise have a tendency to sag. Over time, the taper aspect of heel 24 would be modified and the desired ankle flex as noted herein would be compromised or lost. When a wearer stands in the footwear article 20, the user places weight on the sole at midfoot and forefoot (in addition to placing weight at heel 24). Typically a person will balance by maintaining a slight forward lean or a slight forward angling of the tibia 37 (or shift of body weight to be slightly forward of center body weight for controlled balance, i.e., people subconsciously maintain a slight forward-oriented balance when standing upright and/or when walking). Such forward weight balance allows a user to impart force at the midfoot 26 and forefoot 28 while utilizing plate 50 to extend rearward to support plate heel 124 and thus support, at least in part, a wearer's backwards lean. Such support of the plate heel 124 reduces the tendency of sole 22 to rock or tip backwards (i.e., which would tend to cause tapered heel 24 to touch surface S). Because impact point 30' is oriented anterior to the pivot axis PA and/or PA-H, such back leaning tendency is increased; yet plate 50 accommodates a counter balance to such tip or rocking tendency.

Figure 12:
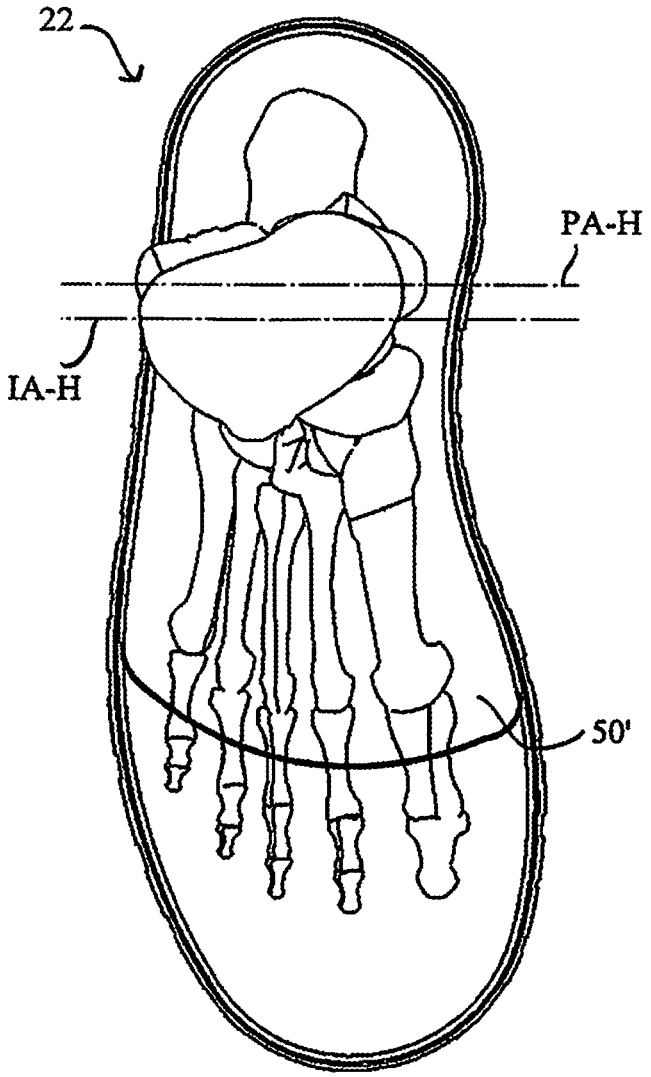
FIG. 12 is a top view of the article of the present invention with portions removed for clarity.

FIG. 12 shows an alternative plate 50' and sole 22. Plate 50' in this aspect does not define a lateral void 142 but includes plate material at the lateral aspect of sole 22. From this view and that of FIG. 5 it may be appreciated that plate 50, 50' terminates before reaching the toes so that the toes can flex unimpeded by the plate 50'.

The plate configuration may vary significantly from that in the exemplary embodiments 50, 50'. The plate generally provides a cantilevered support for the heel 24 to maintain heel shape and adequately bear wearer weight that might otherwise cause backward leaning that could bring the heel into contact with the surface S. Any configuration that will accomplish this is contemplated.

For example, the plate does not need to extend anteriorly to adjacent the toes and could extend to a considerably lesser extent along the midfoot portion so long as the plate is effectively anchored and provides the necessary support for the heel portion. This will generally require a degree of extension anteriorly into the midfoot portion so that the cantilevered heel portion will be adequately stabilized vertically relative to the midfoot portion. The degree of heel support is controlled principally by selecting the appropriate rigidity of the support material and the sole material under the plate anteriorly of the plate heel and against which the plate bears under the user's weight applied at the plate heel.

The plate may have areal sizes and shapes, as viewed from the top of the sole, that are different than those depicted over the plate heel and/or plate midfoot. For example, the plate may be designed primarily to support the plate heel. Alternatively, the plate may be designed primarily to reinforce the sole material, anteriorly of the heel, as against twisting or the like. Appropriate shapes would be selected for these purposes.

The plate can have a uniform thickness or may have strategically thickened regions. In the former case, it could be formed from a single piece of sheet material.

Figure 13:
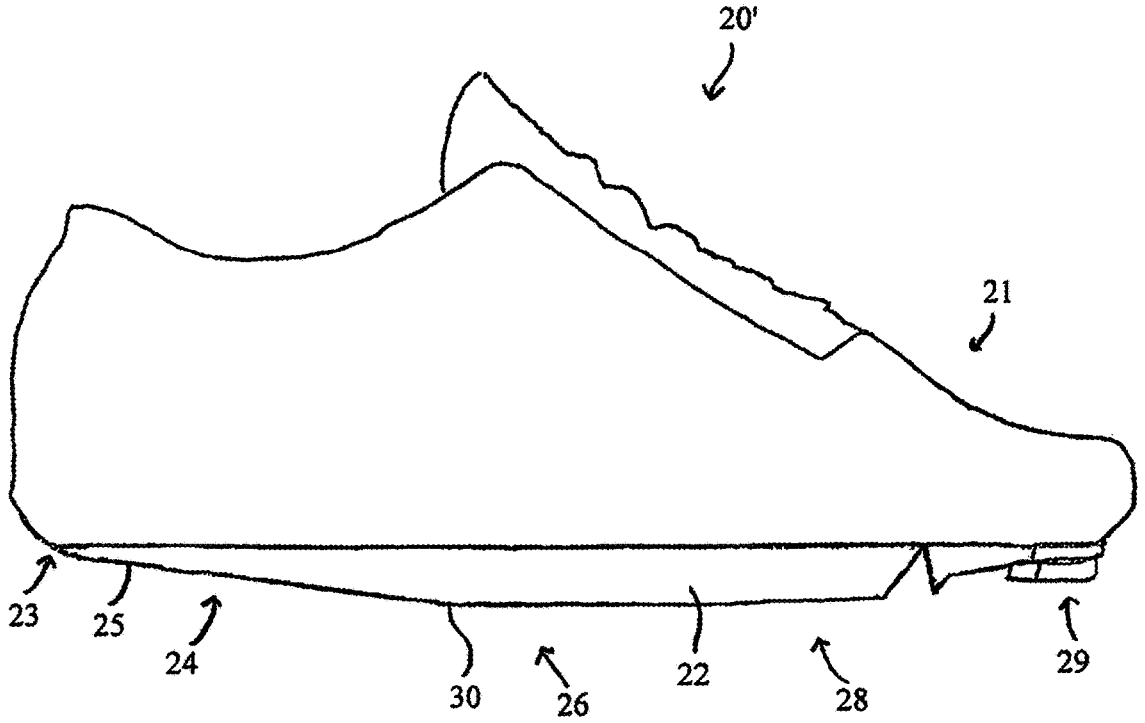
FIG. 13 is an elevation view of or a further aspect of the present invention.
Figure 14:
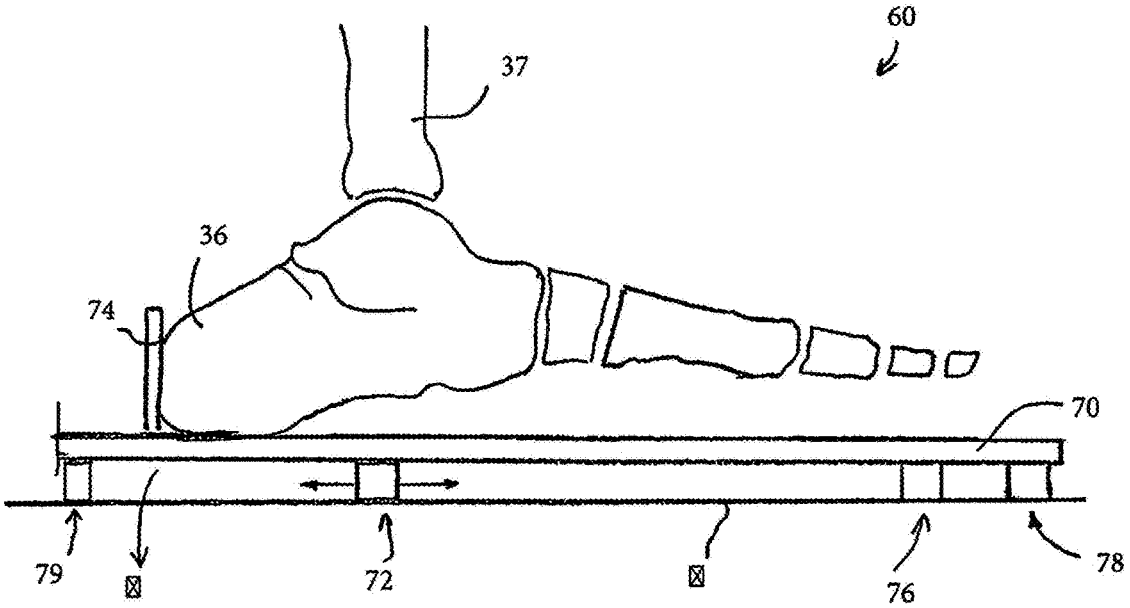
FIG. 14 is a side view of a footwear article in accordance with a further aspect of the present invention.

FIG. 13 shows an alternative article 20' including an upper 21. It may be appreciated that the plate 50, 50' may be contained within article 20'. A variety of different uppers 21 may be used in conjunction with sole 20. Sole 22 may be equipped with a variety of different plates 50, 50'.

In a further aspect, the invention includes a method of customizing a footwear article 20 and/or a sole 22 to a particular user. A person may have his or her feet scanned (digitally, for instance) with the data stored and used to create parts and component parts of article 20 or sole 22. In one aspect a scan will be conducted to determine the pivot axis PA and desired impact axis IA of a user. The profile of the user will be used to create a custom made heel layer (having a plate option) conform to the particular user profile. The various other components of the sole 22 may likewise be custom made or custom selected and assembled to create article 20. In a further aspect, a 3-D or additive printing may be utilized to create the particular components.

In a further method aspect of the invention, the pivot point 30' or junction or pivot line 30 is determined based on the physiology of a particular wearer. In one aspect with respect to FIG. 14, a measuring apparatus 60 includes a tipping board 70 configured to allow a wearer to stand on the board 70 and maintain a balance while standing. A fulcrum 72 is provided (and selectively slid or slidable, shown generally by arrows associated with fulcrum 72) to adjust the tipping or leverage characteristics of board 70. Board 70 may be calibrated before use, and in one instance is pre-positioned to a distance of 27% of the total foot length from the heel (from a posterior backstop 74 associated with board 70). The 27% is used as a common position for a balance point (i.e., a typical pivot axis PA). The total length of the wearer's foot is measured (on or off board 70). The fulcrum 72 is slide forward or backward from the preset point until a least amount of combined pressure on the heels and toes of the wearer is achieved to avoid a forward or backward tipping. The fulcrum position at this event is noted and used as the pivot axis PA (i.e., the position where the ankle pivots most naturally. It may be appreciated that this pivot axis need not be the central vertical axis of the tibia.

The impact point 30' and/or impact axis IA is then determined. In one aspect, an anterior support 76 is provided under plate 70 to assure plate 70 is flat. Beginning at the previously determined ankle pivot point (pivot axis PA), fulcrum 72 is gradually moved forward until the wearer tips the plate 70 backward in the direction of Arrow A. Plate 70 may contact the surface S. The location of the fulcrum 72 is noted which corresponds to a tip back point, or impact point 30' or impact axis IA. Of course, the impact point 30' (and impact line 30, and the skew or orientation of the line 30) may be altered to accommodate more aggressive use and/or for rehabilitation or training purposes (i.e., where the wearer might not always be comfortable but in order to achieve a training or rehabilitative result). The fulcrum 72 may be moved between the ankle pivot point and the tip-back point (i.e., to define a corresponding pivot axis PA, PA-R and desired impact point 30') until the wearer finds the most comfortable position. An anterior support element 76 is or may be provided, at least temporarily, while locating the tip-back point. A pressure gauge or gauges 78, 79 may also be utilized as desired to determine pressures/forces and record readings. The pressure gauges 78,79 may assist in determining if there is a least amount of combined pressure on the heels and toes). Low resistance stops may also be used to inhibit the forward and backward movement of plate 70 so that a person may step on plate 70 without severe tipping. An adjustable counterweight may also be used to balance plate 70 prior to the wearer stepping on plate 70. The wearer may place both feet (or one foot) on board 70 while standing to determine the desired ankle pivot and/or impact point 30'.

A further aspect includes manufacture and/or selection of a sole 22 (and or plate 50, 50', and or article 20, 20') utilizing the impact point data determined in the step or steps noted herein. An aspect of such manufacture and/or selection includes configuring the tapered heel 24 and/or positioning the plate 50 to accommodate a desired ankle flex as noted herein.

Figure 15:
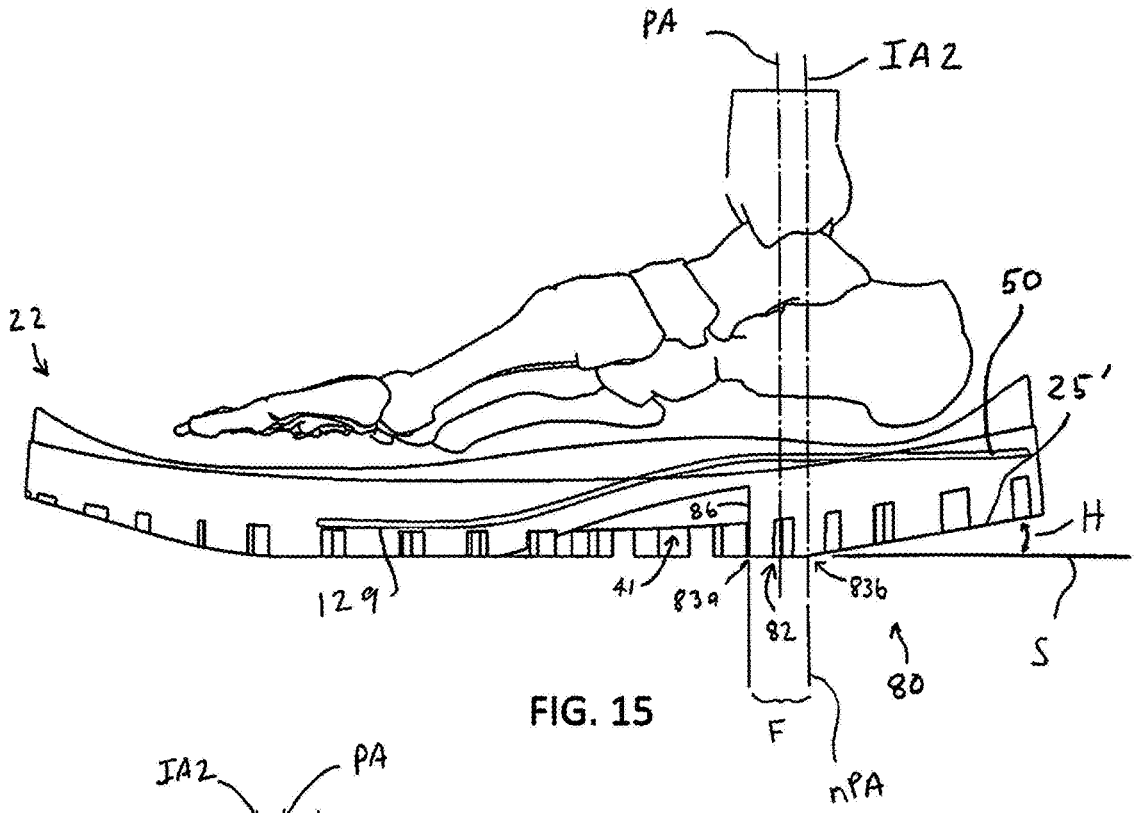
FIG. 15 is a section view of an article of footwear in accordance with an alternative aspect of the present invention and presenting a partial skeletal and flesh structure of a right foot for illustration, an upper removed and a component revealed for clarity.
Figure 16:
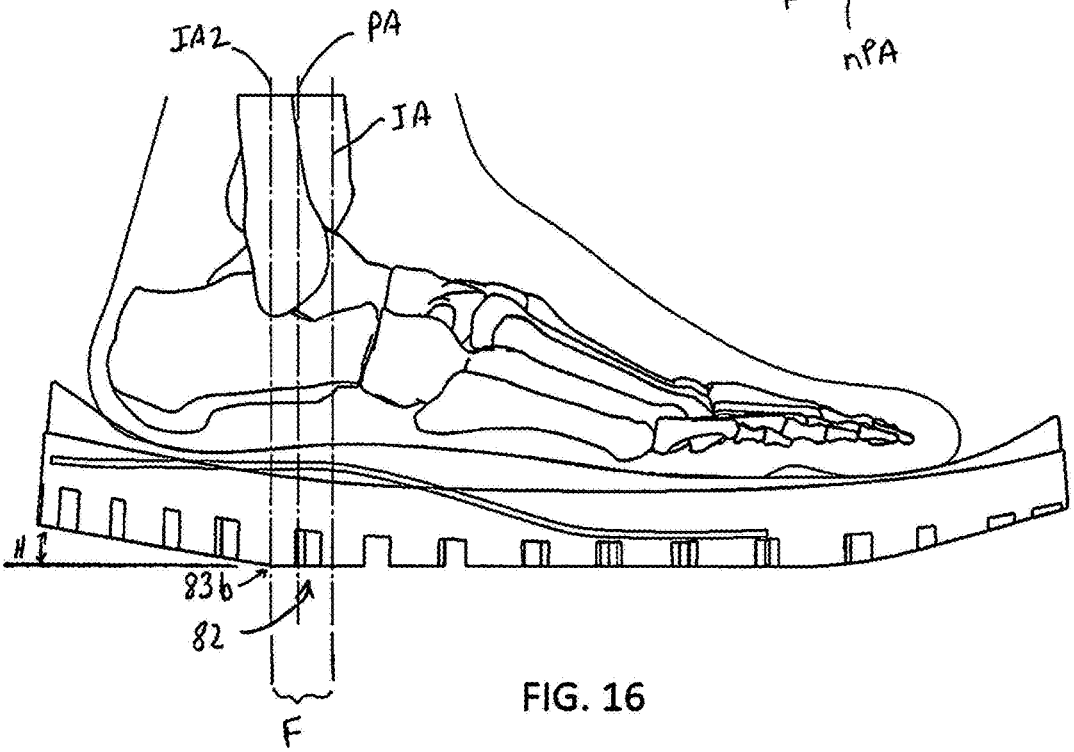
FIG. 16 is a section view of a lateral side of the article of FIG. 15.
Figure 17:
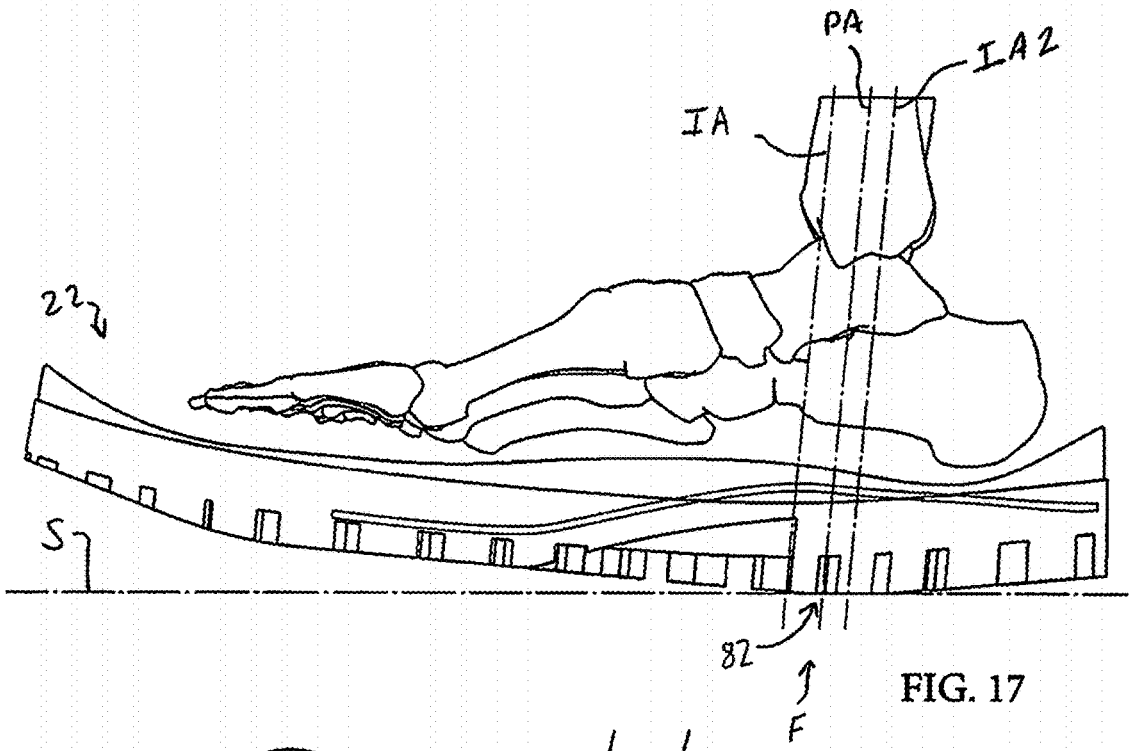
FIG. 17 is a medial side view of the article of FIG. 15 depicting a foot plant.
Figure 18:
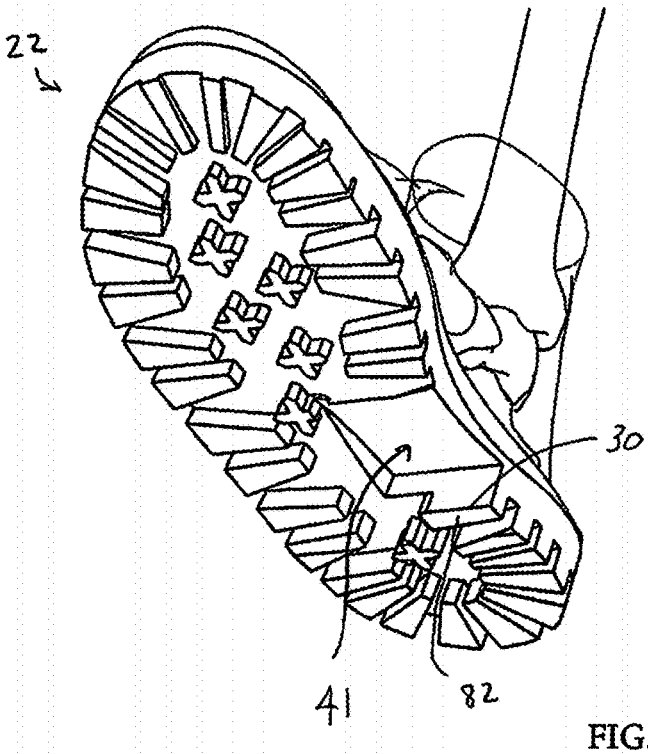
FIG. 18 is perspective view of the article of FIG. 15.

In reference to FIGS. 15, 16 and 17, further aspects of the invention are shown. FIG. 15 shows sole 22 having a heel profile 80 where impact surface 82 is generally flat and extends a distance to create a flat or impact area "F". Heel profile 80 extends rearward along heel line 25'. A shallow heel angle "H", is formed at or between 4 and 10 degrees measured from the surface "S". Heel profile 80 further includes heel wall 86 which is oriented generally vertically in one aspect. In one aspect heel wall 86 corresponds to the Impact Axis IA as noted above. While impact surface 82 is depicted as generally flat, alternative designs are contemplated. In one aspect an anterior end of surface 82 will contact surface S and a posterior end of surface 82 will also contact surface S during a typical walking or running stride. In one aspect surface 82 is configured such that the anterior and posterior ends of surface 82 contact surface S simultaneously at least at some point during a stride. In one aspect sole 22 is made at least in part of material such a rubber or foam or padding such that the sole 22 at impact surface 82 will deform, at least slightly, during a stride upon impact. Having heel line 25' configured at heel angle H accommodates a greater transfer of impact forces to the mid foot 26 of sole 22 upon contact with surface S (compared to a standard non-angled heel sole design). Such relatively shallow heel angle H, at or between 4 and 10 degrees, allows for limited initial heel strike and promotes a relatively smooth rolling action during the stride upon impact across the flat or generally flat area F and into the mid foot 26. Impact surface 82 provides a larger surface area for impact upon surface S compared to a design where the impact line 30 meets with the angled heel line 25 as shown above. Here, impact area 82 extends from impact line 83*a* to impact line 83*b*. The enhanced area F provides additional medial support and decreases the potential risk of asymmetric loss of sole (wear) height at the medial portion of the impact area or area F.

In one aspect, the posterior of impact surface 82 (i.e., at impact line 83*b*) is positioned posteriorly of Pivot Axis PA. As shown in FIG. 15, the posterior of impact surface 82 defines Impact Axis 2 ("IA2"). Configuring IA2 to be posterior of Pivot Axis PA (as opposed to positioning Impact Axis IA anterior of PA) still effectively allows for engaging of the ankle mechanism (dorsiflexion upon impact) because the broader area associated with the loaded portion of the sole (i.e., the impact area "F" or deformed impact area) oriented anterior to the Pivot Axis PA nonetheless promotes engagement of the ankle mechanism for a desired dorsiflex action. In one aspect, a majority of the area "F" is oriented anterior the Pivot Axis PA. Having the majority of impact surface 82 oriented anterior the PA promotes the desired action. In further aspects, the length of impact surface 82 will vary according to preference. In one aspect a relatively lengthy impact surface 82 will result in increased stability as compared to a relatively short impact surface 82. The positioning of the area F with relation to the Pivot Axis PA will also vary according to user preference. Where area F is positioned rearward a greater distance from Pivot Axis PA, a user will experience greater stability (i.e. the user will be less likely to tip backwards when standing still on a flat surface) whereas positioning area F more anteriorly present a more aggressive ankle mechanics for promotion of dorsiflexion whether standing, walking or running. The combination of the tapered heel H and arrangement of the IA in relation to the PA where a majority of the impact surface 82 is anterior a person's pivot axis PA is configured to promote dorsiflexion and also to encourage a wearer to undertake a mid foot strike instead of a primary heel strike. FIG. 17 depicts one aspect of a foot plant such that impact surface 82 at area F undergoes a deformation upon impact with the surface S during a stride. The amount of deformation will generally depend on the nature of the sole material, force of impact and angle of foot plant. In some aspects the sole material at that location will deform or tend to compress or adjust due to the applied forces upon impact.

In a further aspect as shown in FIG. 15, sole 22 includes plate 50, such as a carbon fiber or other plate as noted above. In one aspect, area F or a portion of area F is aligned to correspond with inflection area 130. For instance, in one aspect heel wall 86 will extend such that an axis along wall 86 will intersect with plate 50 at or adjacent inflection area 130. Additionally, plate forefoot 129 (See also FIG. 10) as shown is terminated prior to the end of the toe area of the shoe or boot 20. The length of forefoot 129 may also be varied to preference. Shorter lengths will tend to avoid restriction of the dorsiflexion of the sole 22 during the later phases of the stride. A longer flat forefoot portion 129 provides more stability.

Figure 19:
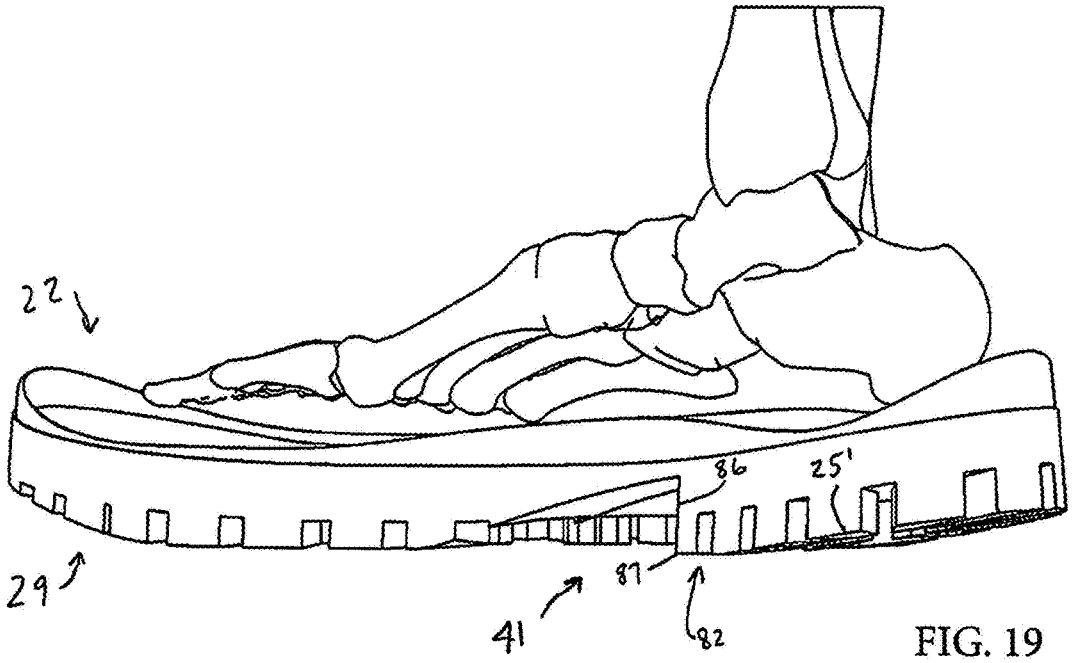
FIG. 19 is a rear perspective view of the article of FIG. 15.

In reference to FIG. 16 which depicts the sole 22 of FIG. 15 from a lateral view, the impact area F is also configured to at least in part coincide with the Pivot Axis. The shallow heel angle H accommodates for a lighter heel impact. The impact area F, or at least a portion of it also corresponds with inflection area 130 of plate 50. In one aspect the posterior aspect of impact surface 82, such as at 83*b*, is oriented posterior of Pivot Axis PA. In reference to FIG. 18, a bottom view depicts generally where void 41 is configured at the medial aspect of the midfoot/heel area of sole 22. FIG. 19 shows impact area 82 represented as a flattened area. The heel line 25' is angled to form heel angle H. Also shown is heel wall 86 meeting with the heel line 25' at the flattened portion to form a corner 87. Heel wall 86 in part defines void 41. An undersurface of sole 22 at void 41 is also shown as angled and slopes downward toward the toe 29. Also shown in FIG. 19 is a general representation of where impact area F is positioned such that at least a majority of the impact area F is positioned anterior pivot axis PA.

Figure 20:
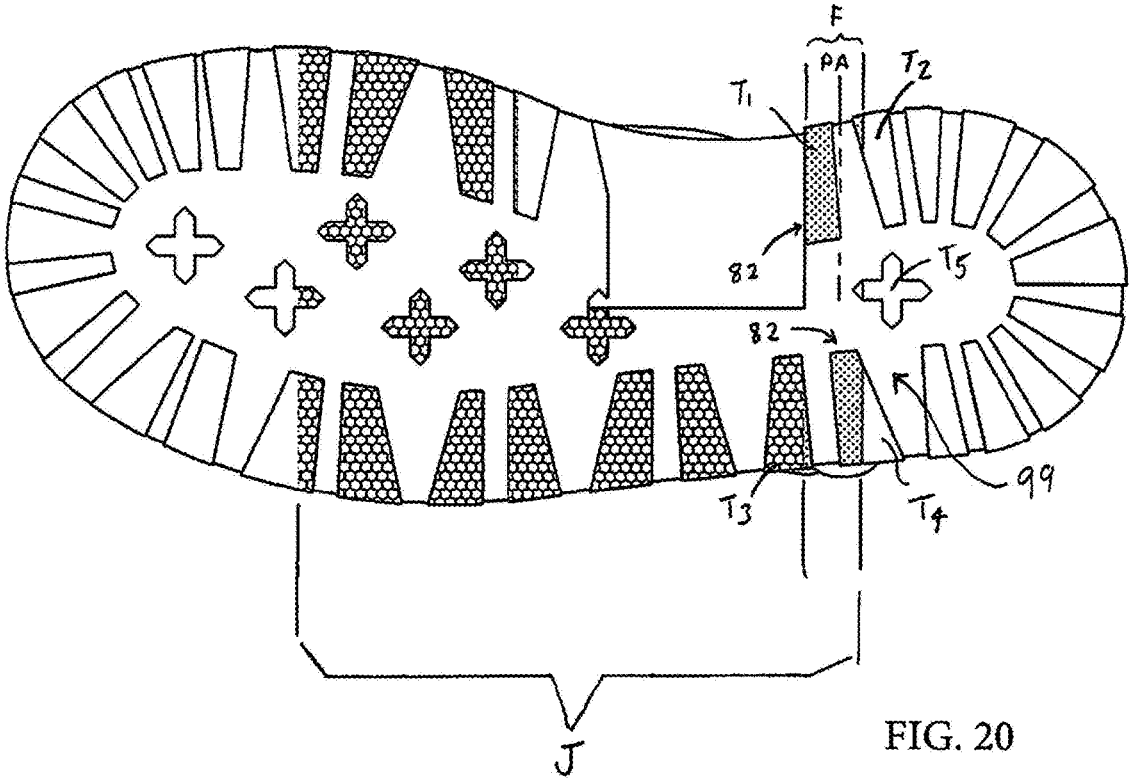
FIG. 20 is a bottom view of the article of FIG. 15.

FIG. 20 depicts a bottom view of sole 22. Region "J" which is shaded or includes shading represents one aspect where the underside of sole 22 is flat. All of the shaded areas are generally flat or planar. Area F, which is also flat or generally flat, is depicted with a different shading and corresponds to impact surface 82. Impact surface 82 is flat or generally flat, and comprises or is presented on different tread elements "T" in one aspect. A tread element T projects from the bottom of sole 22 and may be partially flat or partially angled. The tread elements T, or some of them, will deform or tend to deform upon impact. In one aspect, the portions of tread elements positioned anterior the pivot axis PA of a wearer are greater than the portions of the tread elements of the area F that are posterior in relation to the Pivot Axis. The tread elements T, or portions of such elements T, laying within region "J", are all flat or generally flat.

Figure 21:
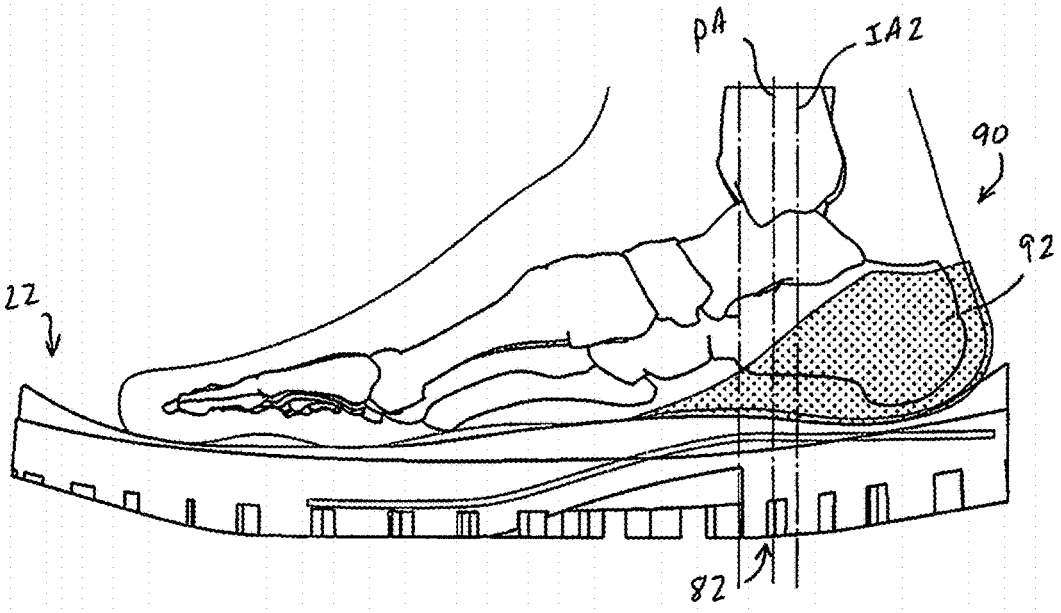
FIG. 21 is a medial view of an article of footwear in accordance with an alternative aspect of the present invention and presenting a partial skeletal and flesh structure of a right foot for illustration, an upper removed and a component revealed for clarity.
Figure 22:
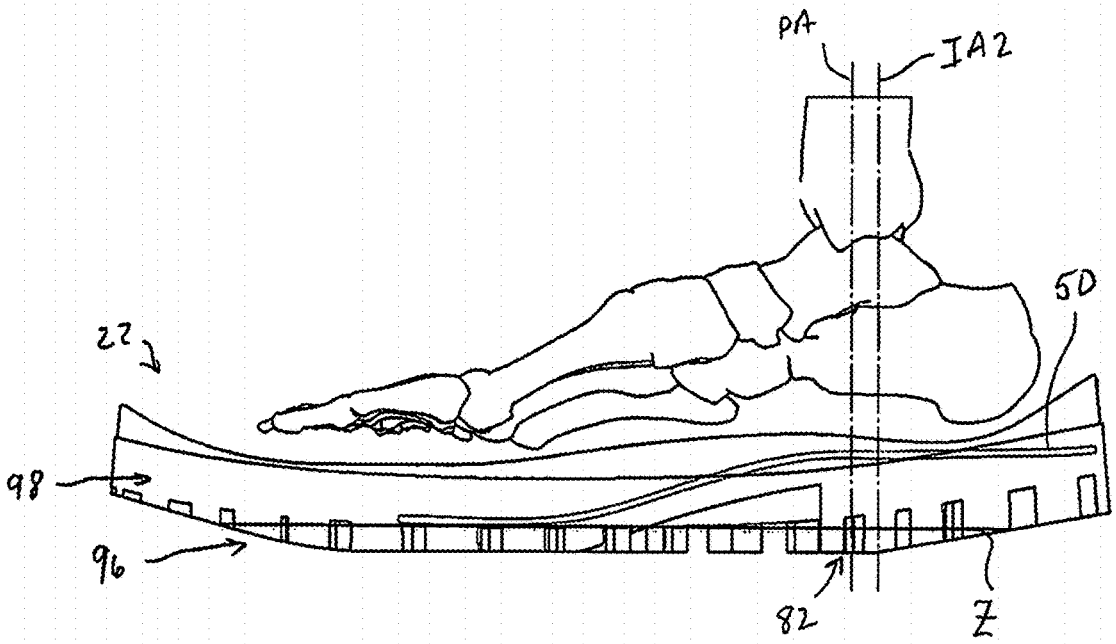
FIG. 22 is a medial view of an article of footwear in accordance with an alternative aspect of the present invention and presenting a partial skeletal and flesh structure of a right foot for illustration, an upper removed and a component revealed for clarity.

In further aspects the invention includes footwear 20 or a sole 22 which allows a user to adjust the impact line 30 or Impact Axis IA. With reference to FIG. 21 and FIG. 22, footwear 20 includes an adjustment mechanism such that the wearer may adjust the location of the Impact Axis IA2 in relation to their own Pivot Axis PA or to their preference. In one aspect adjustment mechanism 90 includes a heel cradle 92 configured to receive the heel of a wearer. The cradle 92 is associated with a sole 22 which is slightly oversized for the wearer. Cradle 92 is configured to slide upon sole 22. By sliding cradle 92, the user's Pivot Axis PA is adjusted in relation to the preset Impact Axis of sole 22, thereby altering the mechanical relationship to change the nature of ankle flex and stability. Cradle 92 is configured to move fore or aft upon sole 22. A cable or strap in one aspect is used to secure cradle 92 to sole 22 upon adjustment to a desired position. The cable or strap may be connected to the cradle 92 at one end and to the mid foot and/or fore foot area of the sole at an opposite end. Cradle 92 may be preset such that the majority (or statistically significant amount) of users who place their ankle in cradle 92 will have a Pivot Axis which aligns or nearly aligns with the pre-set Impact Axis of the footwear. Cradle 92 is then adjusted, fore or aft, to adjust the relationship of the person's ankle (i.e., and Pivot Axis PA) with respect to the Impact Axis. A variety of adjusting mechanisms and locking mechanisms may be utilized in conjunction with cradle 92, including a portion having serrations which mate with serrations contained on sole 22, such that movement of cradle 92 may be accomplished yet secured in a location with associated locking tabs once the desired position is achieved. Each serration may be configured to accommodate for incremental movement of the cradle at a set amount, such as 5 mm (i.e., moving from one mating serration to another will adjust the cradle 92 in 5 mm increments with respect to the sole. A ratchet and buckle aspect may also be used with the adjusting mechanism 90, where the ratchet and buckle include a release tab to allow for sliding of cradle 92 and subsequent setting by activation or release of the tab to set cradle 92 in a desired position. The adjusting mechanism may also include a screw or roller where the user rotates the screw or roller which in turn adjusts the location of cradle 92 with respect to sole 22. As the location of cradle 92 is adjusted, a portion of an upper area of sole 22 may become exposed, or cradle 92 might also extend rearward to conceal the exposed area and/or where cradle 92 may extend slightly rearward of the terminal end of sole 22.

With respect to FIG. 22, in one aspect, an adjustable sliding mechanism is used to move a lower portion 96 of the sole (which portion includes the impact surface 82) in relation to an upper portion 98 of the sole 22. In one aspect sole 22 is split generally horizontally as shown with reference to line "Z". A lower portion 96 of the sole 22 which includes impact surface 82 adjusts fore or aft so that the positioning with respect to an inserted ankle and the associated Pivot Axis is modified. The lower portion 96 of sole 22 may slide along a track of upper portion of sole 22 (or vice versa) and be set into position with release/locking tabs. A screw or roller mechanism in one aspect is also used to accommodate adjustment of the lower portion of the sole. A cable or strap in one aspect is used to secure lower portion 96 to upper portion 98. A ratchet and buckle in one aspect are used to adjust and set the lower portion 96 with the upper portion 98. Plate 50 is contained in upper portion 98.

In further aspects the invention includes methods for ascertaining the Pivot Axis PA of a wearer and/or determining a recommended or desired Impact Axis IA. Once ascertained or determined, the information of the PA and/or IA is used to accommodate a desired selection or manufacture of (including but not limited to custom manufacture) footwear articles.

One method of ascertaining the position of the Pivot Axis PA is having a person try on footwear having different IA. The impact point 30 (or impact surface 82) acts as a fulcrum during the trial, allowing the user to experience a variety of tip-back options. Alternatively, a wearer may stand on the device described previously (see with respect to FIG. 14, for instance), or a wearer may stand on a simple plate with the fulcrum positioned at the desired location of the impact point (or of the location of the posterior-most aspect of impact surface 82). The fulcrum is adjusted anteriorly to simulate an impact point with an early ankle engagement (dorsiflexion) or posteriorly to simulate more stability. A measurement of the location of the fulcrum and corresponding IA is made, including notation of the measure of the distance between a posterior of the wearer's foot or footwear and the IA and/or fulcrum location. Similar measurements are made as necessary for determining the PA of a wearer.

A method for determining possible ranges of positioning for a desired impact point or ascertaining the Pivot Axis of an individual also includes use of physiologic measurements (as detailed with the fulcrum mechanisms) and/or anatomic measurements. A key anatomy feature includes the midpoint of the talar dome. The midpoint of the talar dome is or is often considered to be the anatomic pivot point of the ankle. A stride impact location anterior to the mid talar dome will or should result in dorsiflexion of the ankle. While a lateral prone penetrating X-ray or CT would be useful to determine the exact position of the talar dome, such steps require unnecessary radiation and expense (but may be used as desired or needed). Other bony landmarks of the ankle such as the medial and lateral malleolus might not be exact, yet still provide reference points to approximate (to a reasonably acceptable degree in most cases), the location of the mid talar dome. Particularly, when a person is in the upright standing position, the midpoint of the medial and/or lateral malleolus approximates the location of the mid Talar dome in the anterior-posterior plane. In one aspect the mid malleolar points are identified by scanning the bony protrusions on the skin surface and/or marking the anterior and posterior aspects of the malleolus, and then calculating the midpoint. The mid talar dome can be used as a starting location for determining the location of the Pivot Axis and the ideal location of the impact point or impact axis IA or IA2. Positioning the impact point or IA or IA2 close to the position of the mid talar dome and/or PA will allow for early engagement of the ankle mechanism while still providing stability. Calipers and other tools or visual assistants or measuring devices are also available to ascertain the location of the PA.

In one aspect plate 50 is configured or positioned such that inflection area 130 corresponds with heel wall 86. In other aspects inflection area 130 corresponds with (or is positioned anterior) a location of a typical (or statistically significant) pivot axis PA of wearers.

In a further aspect the invention includes ascertaining the Pivot Axis PA of a wearer and then matching the foot of a wearer with a footwear 20, 20' such that a majority of the impact area 82 or area F (i.e. of the impact surface 82 in one aspect) is positioned anterior the Pivot Axis PA. Matching the foot of the wearer may include sampling or trying on a variety of footwear having slightly different Impact Axis and area F characteristics (and in some aspects, matching with a variety of different configurations of plate 50). Other matching of the foot includes custom manufacture of footwear 20 to the particular characteristics of the wearer's foot. The mechanisms stated previously for ascertaining a person's PA are used in one aspect of the present method. A person may select from a variety of footwear articles that each have the same size or appropriate "fit" on the foot of the wearer, but differ in terms of the Impact Axis and area F. For instance, impact surface 82 may be longer or shorter as desired, the area F may be positioned anterior or posterior the wearer's PA (or at various locations and with preference for a majority of the area F to align anterior the PA). The length of heel wall 86 and thickness of sole 22 may vary as desired. The heel angle H may also vary. The foregoing variable features collectively impact the desired performance for a wearer and are adjusted to the individual preferences of the wearer. In some instances there can be a combination of the size of impact surface 82 and positioning of IA2 with respect to the PA that satisfy the desires of a large group of consumers. Such combinations are established as standards or "baseline" preferences. Modifications to the standards or baselines can be created in increments, and indexed, so that footwear 20 may be mass produced with popular characteristics.

In one aspect a plurality of identical size shoes may be mass produced such that each shoe is identical or nearly identical in terms of size, shape and style, but different in terms of the sole 22, such as different in terms of the Impact Axis location, impact surface length 82, heel angle H and/or plate 50, for instance.

In a further aspect, a convenient reference list of the measures or locations of the Impact Axis is established, such as forming an Impact Index™ which assists consumers in convenient and consistent identification of the different varieties and degrees of soles having differing locations or features of Impact Axes. A reference system is contemplated, for instance, where an Impact Index value of zero ("0") represents a sole 22 where the Impact Axis aligns with the wearer's (or a statistical average or statistically significant measure of most wearer's) Pivot Axis, together with a typical (or statistically significant) length of impact surface 82 (such as 1.5 cm), together with a typical (or statistically significant) heel angle H (such as 6 degrees, for instance). Different varieties of plate 50 may also be used to represent an Impact Index value of zero. In one aspect the Impact Index of zero may be expressed as an abbreviation such as II−0 (or some other notation). Other features may also be represented with such or similar indexed values. Various additional Impact Index values may also be used, such as Impact Index+1, or II+1 (i.e., the sole may have the same features as a sole having II−0, but where the Impact Axis is positioned 1 centimeter (or some other distance) to the anterior side of the PA (i.e., the PA of a statistically significant or average pool of users). An Impact Index of −1, or II−1, would represent the same sole having the IA located 1 centimeter to the posterior side of the PA. A plurality of mass produced footwear may thus be produced while also accommodating the needs or preferences of wearers based on the foregoing features. Because the PA may vary from wearer to wearer, a sole having IA+1 may be such that the IA aligns with the PA of that particular wearer. Accordingly, having the variety of soles of differing Impact Index will accommodate greater efficiency in providing a desired match of foot with footwear.

In further method aspects, the invention includes manufacture of footwear, and particularly manufacture of a sole for a shoe or boot. An ankle of a wearer has certain inherent ankle pivot characteristics which result from the anatomical structure of that particular wearer. In one aspect the ankle with have a natural ankle pivot point which corresponds to a natural ankle pivot Axis nPA when normalized with respect to the surface S. The natural ankle pivot axis nPA is the natural structural joint or hinge location. The ankle pivot point is an anatomic point where pressure applied to the bottom of the foot results in no plantar flexion or dorsiflection. If upward pressure is moved anterior to this point, there is a vector force for the foot to dorsiflex. If the upward pressure is moved posterior to the pivot point, the vector forces the foot to plantar flex. The center of the talar dome is the closest anatomic location for this point. Apart from use of a lateral xray, there are limited methods for accurately locating this point; however, the mid fibula or the mid medial malleolus may be used as close approximates when the wearer is in the upright standing position. A balance pivot axis, however, is different compared to the natural ankle pivot axis nPA, and applicant has found that ascertaining the location of the balance pivot point or balance pivot axis is helpful in the configuration of a sole under the invention. The balance pivot point or balance pivot axis (herein the pivot axis PA) is that point where the forces present on the anterior side of the point equal the forces on the posterior side of the point. A wearer balancing on a rigid plate and fulcrum as describe previously, for instance, will experience an equilibrium when the position of the balance pivot point or balance pivot axis is located. Such position will be identified and is considered the balance pivot axis or pivot axis PA. This point or balance pivot axis PA is always anterior to the natural ankle pivot axis nPA because people stand leaning forward to maintain balance. The balance point of an ordinary wearer is affected by body position and muscle engagement. Use of a tipping device as describe herein measures this point and balance axis. Applicant has found that there is a small range of which the balance pivot axis PA is a part, i.e., a wearer typically experiences ankle balance an equilibrium over a range of comfort. The PA of the present invention may thus include a range of positions instead of a single point or axis.

The ankle pivot axis PA may be measured and/or calculated. The natural ankle pivot axis nPA may also be measured and/or calculated. In one aspect the nPA may is measured by use of a no-load or minimal load technique where a seated wearer places his foot on a rigid plate positioned on a fulcrum or roller. An elastic band is used to apply tension between the wearers bent knee and the rigid plate to assure the foot maintains a consistent positioning on the plate. The fulcrum or roller is adjusted under the plate by moving the fulcrum point posteriorly to achieve a corresponding plantar flexion of the ankle (i.e., the toes drop). By slowly adjusting the roller or the fulcrum point with respect to the rigid plate, the toes will raise or begin to raise. At this point where the foot begins to move in a dorsiflex manner is the beginning of the balance pivot axis PA or the comfortable range of measure for the PA. This point is noted or marked. As small range of movement of the fulcrum point or roller will result in a dramatic change in the ankle movement once the fulcrum has passed beyond the PA or the small PA range. The same dynamic works in reverse where movement of the fulcrum to a position anterior the ankle pivot axis PA will cause the foot to dorsiflex. This position may also be marked and together with the prior marked position generally establish the range of the PA. Because the Achilles tendon and muscle or other structures in conjunction with a wearer's natural tendency to adjust to maintain balance, the above test or measurement is performed seated or without bearing weight. In this manner the natural ankle pivot axis nPA can be determined.

In manufacture of sole 22, 22' under one aspect of the invention, the location of the impact axis IA is based on the position of the nPA and/or the PA. In other aspects, the ankle pivot characteristic of a wearer (in a custom manufacture) or a typical wearer (in mass production) is used at least in part to determine or configure an impact point, to determine or configure an impact profile, the angle or a measure of heel taper H, a configuration of a plate 50 used with the sole 22, 22', selection of material used to make the sole, determination of a thickness of the sole, among other aspects. In one aspect, the impact point IA2 is positioned posterior PA no greater than 1 cm when the footwear is subject to a normal standing load of the wearer. Positioning beyond 1 cm posterior the PA diminishes the tendency of a desired dorsiflex action upon foot plant. Where the IA2 is positioned closer to, at, or anterior PA, the wearer may tend to sense or realize a backward tipping action. In some instances the wearer will desire such configuration for training or competition purposes. Use of a plate in conjunction with such configuration will accommodate use of desired footwear materials without a resulting deformation or sagging of the heel.

The PA and nPA may also be measured by visual inspection and/or feel and/or scan. The PA and nPA may also be calculated based on averages and statistics of a sufficient pool of wearers to determine common and/or optimal positioning of the IA for mass production of various sizes of footwear to meet the needs of wearers. The PA and nPA may also be calculated based on sight or use of a balance board.

With reference to FIG. 15 and FIG. 20, the impact area F can be constructed depending on the desires of the wearer. For instance, if the wearer desires a more aggressive dorsiflex action upon foot plant, the impact axis IA2 is positioned closer to the balance pivot axis PA. For more stability, the IA2 is positioned or moved posteriorly away from PA. As shown in FIG. 15, in one non-limiting example IA2 coincides with nPA. Note that the balance pivot axis PA is located anterior the natural pivot axis nPA. Because individual wearers are different, the positioning of the PA and IA2 may vary according to preference.

The nature of the material comprising sole 22 also impacts the determination of where to position IA2 and what impact profile is to be used. With a sole having a compressible outsole and midsole, the impact area F or impact loading zone, is the portion of the sole that deform or flattens upon the surface S when a foot strike is applied at the impact area F. The impact is designed to avoid initial contact with the heel or the midsole. If the wearer performs a limited heel strike, the impact area F is deformed as the loaded portion moves between the tapered heel portion and the flat midfoot area. As shown in FIG. 17 the initial plant will be at impact area F. As shown in FIG. 20, the impact area F also shows where impact axis IA2 is a posterior-most aspect in contact with the surface S when the footwear rests naturally upon the surface S (and also where the footwear is subject to a normal standing load of the wearer, i.e., the heel does not sag or compress to contact the surface S). In FIG. 20 an impact point or impact axis IA2 comprises at least in part the impact profile 99 which in this instance is a broken line with a portion of the line at tread element T2, a portion of the broken line at tread element T4, and a portion of the line at tread element T5. The broken line of the present profile 99 runs generally straight from medial edge to lateral edge of the sole. Other impact profiles are contemplated. For instance, the impact profile 99 may comprise a straight unbroken line where the tread is flat and the line runs from lateral edge to medial edge of the sole. The impact profile 99 may also be jagged, skewed, curved, concave or convex, angled or comprise other configuration. The impact profile 99 in one aspect is configured based on the wearer's measured or calculated ankle pivot axis PA. In further aspects, the ankle pivot axis or balance pivot axis is used to configure plate 50. The inflection area of plate, and the size, thickness, material and overall shape may be configured based on data pertaining to the PA or nPa. The PA or nPA in other aspects is used to configure the taper of the heel and the amount of angle of the taper with respect to surface S. The heel may taper along a straight line or may also be curved or vary from terminal end of the heel to the impact profile.

The foregoing relates to exemplary embodiments of the invention and modifications may be made without departing from the spirit and scope of the invention as set forth in the following claims. The scope of this invention also includes embodiments having different combinations of features and embodiments that do not include all of the above described features.

What is claimed is:

1. A method of manufacturing a shoe or boot into which a wearer inserts a foot, the foot associated with an ankle having an ankle pivot axis or balance pivot axis, the method comprising:

ascertaining a wearer's ankle pivot axis or balance pivot axis; and configuring a sole of the shoe or boot with an impact point being a posterior-most aspect of the sole in contact with a surface when the shoe or boot rests naturally upon the surface, the impact point positioned on the sole substantially in alignment with the pivot axis or balance pivot axis and within a rear one-third of the sole.

2. The method of claim 1 where the step of ascertaining the wearer's pivot axis or balance pivot axis includes measuring or calculating the ankle pivot axis or balance pivot axis.

3. The method of claim 2 where the measured or calculated ankle pivot axis or balance pivot axis is used to configure the impact point of the sole.

4. The method of claim 3 where the impact point is part of an impact profile of the sole.

5. The method of claim 3 where the impact point is a posterior-most aspect of the sole in contact with a surface when the shoe or boot is subject to a normal standing load of the wearer.

6. The method of claim 2 where the measured or calculated ankle pivot axis or balance pivot axis is used to configure a plate to be used with the sole.

7. The method of claim 2 where the measured or calculated ankle pivot axis or balance pivot axis is used to configure a heel taper of the sole.

8. The method of claim 1 where the impact point in part defines an impact profile, the impact profile comprising a line oriented generally transverse a length of the shoe or boot.

9. The method of claim 1 where the balance pivot axis is determined by use of a balance pivot axis measuring device.

10. The method of claim 9 further comprising measuring or calculating the ankle pivot axis or the balance pivot axis of a wearer and manufacturing the sole by positioning the impact point based at least in part upon such measurement or calculation of the ankle pivot axis or the balance pivot axis.

11. The method of claim 1 where the impact point is located posterior the ankle pivot axis or the balance pivot axis no greater than 1 cm when the shoe or boot is subject to a normal standing load of the wearer.

12. The method of claim 1 where the sole includes a tapered heel and a plate.

13. The method of claim 12 where the plate is configured based upon the ankle pivot axis or balance pivot axis.

14. The method of claim 1 where the step of ascertaining the ankle pivot axis or balance pivot axis includes analysis of ankle pivot axis or balance pivot axis of a pool of wearers.

15. A method of manufacturing a shoe or boot into which a wearer inserts a foot, the foot associated with an ankle having an ankle pivot axis or balance pivot axis, the method comprising:

ascertaining the wearer's ankle pivot axis or balance pivot axis;

configuring a sole of the shoe or boot with an impact point being a posterior-most aspect of the sole in contact with a surface when the shoe or boot is subject to a normal standing load of an ordinary wearer, the impact point positioned substantially in alignment with the ankle pivot axis of an ordinary wearer of the shoe or boot, the impact point positioned within a rear one-third of the sole; and configuring the sole with a rigid plate extending from a midfoot portion of the sole to posterior the impact point such that compression or sag of a heel of the sole is reduced or eliminated, the impact point positioned on the sole such that an ordinary wearer of the shoe or boot will avoid tipping backwards when standing naturally.

16. The method of claim 15 where the impact point is positioned at or between a balance pivot axis of an ordinary wearer and within at least 1 cm posterior of an ankle pivot axis of an ordinary wearer.

17. A method of fitting a foot of a person with a shoe or boot, the method comprising:

ascertaining a measured or calculated ankle pivot axis or balance pivot axis of the wearer; and matching the foot with a shoe or boot having a sole with an impact point substantially in alignment with the ankle pivot axis or balance pivot axis, the impact point being a posterior-most aspect of the sole in contact with a surface when the shoe or boot rests naturally upon the surface, the impact point positioned at a rear third of the sole.

18. The method of claim 17 where the impact point aligns along the ankle pivot axis or the balance pivot axis.

19. The method of claim 17 where the impact point is positioned anterior the ankle pivot axis or the balance pivot axis.

20. The method of claim 17 where the impact point is positioned posterior the ankle pivot axis or the balance pivot axis.

21. The method of claim 17 further comprising inserting the foot into the shoe or boot having the sole with the impact point corresponding to the ankle pivot axis or the balance pivot axis.

22. The method of claim 17 where a central vertical axis of a tibia of the user is utilized as the measured or calculated ankle pivot axis of the wearer.

23. The method of claim 17 where the impact point is positioned a distance from a rear terminal end of the sole at or between 18 to 32 percent of the length of the sole.

24. The method of claim 17 where a midfoot of the sole includes a void defined in part by a heel wall extending only at a medial portion of the midfoot, the midfoot includes a flat region at a lateral portion of the sole.

25. The method of claim 17 where ascertaining the ankle pivot axis or balance pivot axis includes sampling a variety of footwear having a same fit size and having different impact point characteristics.

* * * * *